US010670293B2

(12) United States Patent
Abiprojo et al.

(10) Patent No.: US 10,670,293 B2
(45) Date of Patent: Jun. 2, 2020

(54) HVAC SYSTEM MODE DETECTION BASED ON CONTROL LINE CURRENT

(71) Applicant: Emerson Electric Co., St. Louis, MO (US)

(72) Inventors: Priotomo Abiprojo, O'Fallon, MO (US); Jeffrey N. Arensmeier, Fenton, MO (US)

(73) Assignee: EMERSON ELECTRIC CO., St. Louis, MO (US)

( * ) Notice: Subject to any disclaimer, the term of this patent is extended or adjusted under 35 U.S.C. 154(b) by 1162 days.

(21) Appl. No.: 14/716,104

(22) Filed: May 19, 2015

(65) Prior Publication Data

US 2015/0362207 A1 Dec. 17, 2015

Related U.S. Application Data

(60) Provisional application No. 62/011,471, filed on Jun. 12, 2014.

(51) Int. Cl.
*F24F 11/62* (2018.01)
*F24F 11/30* (2018.01)
(Continued)

(52) U.S. Cl.
CPC ..... *F24F 11/62* (2018.01); *F24F 11/30* (2018.01); *F24F 11/32* (2018.01); *F24F 11/52* (2018.01);
(Continued)

(58) Field of Classification Search
CPC ..... G05B 23/0224; F24F 11/62; F24F 11/30; F24F 11/32; F24H 3/00
(Continued)

(56) References Cited

U.S. PATENT DOCUMENTS 6,456,473 B1 * 9/2002 Olson ..... H02H 3/087 361/91.1
6,647,203 B1 * 11/2003 Helt ..... F24H 9/2071 219/541
(Continued)

FOREIGN PATENT DOCUMENTS

CN 101324363 A 12/2008
CN 101449223 A 6/2009
(Continued)

OTHER PUBLICATIONS

"Current Loop Application Note" B&B Electronics, Home page www.bb-elec.com, Jan. 1995, pp. 1-13.*
(Continued)

*Primary Examiner* — Regis J Betsch
*Assistant Examiner* — Kaleria Knox
(74) *Attorney, Agent, or Firm* — Harness, Dickey & Pierce, P.L.C.

(57) ABSTRACT

A monitoring system for monitoring a heating, ventilation, and air conditioning (HVAC) system of a building includes a monitoring server. The monitoring server is configured to receive an aggregate control line current value from a monitoring device. The aggregate control line current value represents a total current flowing through control lines used by a thermostat to command the HVAC system. The monitoring server is configured to determine a commanded operating mode of the HVAC system in response to the aggregate control line current value. Operating modes of the HVAC system include at least one of an idle mode and an ON mode. The monitoring server is configured to analyze a system condition of the HVAC system based on the determined commanded operating mode.

24 Claims, 9 Drawing Sheets

(51) Int. Cl.

| | |
|---|---|
| ***F24F 110/00*** | (2018.01) |
| ***F24F 140/50*** | (2018.01) |
| ***F24F 11/32*** | (2018.01) |
| ***F24F 11/63*** | (2018.01) |
| ***F24F 11/56*** | (2018.01) |
| ***F24F 11/52*** | (2018.01) |

(52) U.S. Cl.
CPC ..... *F24F 11/56* (2018.01); *F24F 11/63* (2018.01); *F24F 2110/00* (2018.01); *F24F 2140/50* (2018.01)

(58) Field of Classification Search
USPC ..... 700/276
See application file for complete search history.

(56) References Cited

U.S. PATENT DOCUMENTS

2003/0061344 A1* 3/2003 Monroe ..... G08B 25/085 709/224
2006/0124759 A1* 6/2006 Rossi ..... F24F 11/30 236/51
2009/0088902 A1* 4/2009 Williams ..... F24F 11/30 700/278
2010/0238003 A1* 9/2010 Chan ..... G01D 4/004 340/538
2011/0160914 A1* 6/2011 Kennett ..... F24F 13/14 700/276
2012/0221150 A1* 8/2012 Arensmeier ..... G05B 23/0224 700/276
2013/0096723 A1 4/2013 Ludwig
2013/0201316 A1* 8/2013 Binder ..... H04L 67/12 348/77
2014/0074730 A1 3/2014 Arensmeier et al.
2014/0084072 A1* 3/2014 Conner ..... G05D 23/1919 236/1 C
2014/0151456 A1 6/2014 McCurnin et al.

FOREIGN PATENT DOCUMENTS

| | | | |
|---|---|---|---|
| CN | 101907335 | A | 12/2010 |
| CN | 102514526 | A | 6/2012 |
| CN | 103001230 | A | 3/2013 |
| CN | 103597292 | A | 2/2014 |
| CN | 103630739 | A | 3/2014 |
| WO | WO-2014033189 | A1 | 3/2014 |

OTHER PUBLICATIONS

International Search Report regarding International Application No. PCT/US2015/035652, dated Sep. 25, 2015.
Written Opinion of the International Searching Authority regarding Application No. PCT/US2015/035652, dated Sep. 25, 2015.
Chinese Office Action regarding CN Patent Application No. 201580037821.5 dated Dec. 3, 2018.
Chinese Office Action regarding CN Patent Application No. 201580037821.5 dated Aug. 8, 2019; 8 pages.

* cited by examiner

| Mode of Operation | Control Lines Activated | Control Line Current Level |
|---|---|---|
| Idle | None | 40 mA |
| Heating | W | 60 mA |
| Fan only | G | 110 mA |
| Heating plus Fan | W with G | 150 mA |
| Cooling | Y with G | 600 mA |

FIG. 4

HVAC SYSTEM MODE DETECTION BASED ON CONTROL LINE CURRENT

CROSS-REFERENCE TO RELATED APPLICATIONS

This application claims the benefit of U.S. Provisional Application No. 62/011,471, filed on Jun. 12, 2014. The entire disclosure of the application referenced above is incorporated herein by reference.

FIELD

The present disclosure relates to environmental comfort systems and more particularly to remote monitoring and diagnosis of residential and light commercial environmental comfort systems.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A residential or light commercial HVAC (heating, ventilation, or air conditioning) system controls environmental parameters, such as temperature and humidity, of a building. The target values for the environmental parameters, such as a temperature set point, may be specified by a user or owner of the building, such as an employee working in the building or a homeowner.

In FIG. 1, a block diagram of an example HVAC system is presented. In this particular example, a forced air system with a gas furnace is shown. Return air is pulled from the building through a filter 104 by a circulator blower 108. The circulator blower 108, also referred to as a fan, is controlled by a control module 112. The control module 112 receives signals from a thermostat 116. For example only, the thermostat 116 may include one or more temperature set points specified by the user.

The thermostat 116 may direct that the circulator blower 108 be turned on at all times or only when a heat request or cool request is present (automatic fan mode). In various implementations, the circulator blower 108 can operate at multiple speeds or at any speed within a predetermined range. One or more switching relays (not shown) may be used to control the circulator blower 108 and/or to select a speed of the circulator blower 108.

The thermostat 116 provides the heat and/or cool requests to the control module 112. When a heat request is made, the control module 112 causes a burner 120 to ignite. Heat from combustion is introduced to the return air provided by the circulator blower 108 in a heat exchanger 124. The heated air is supplied to the building and is referred to as supply air.

The burner 120 may include a pilot light, which is a small constant flame for igniting the primary flame in the burner 120. Alternatively, an intermittent pilot may be used in which a small flame is first lit prior to igniting the primary flame in the burner 120. A sparker may be used for an intermittent pilot implementation or for direct burner ignition. Another ignition option includes a hot surface igniter, which heats a surface to a high enough temperature that, when gas is introduced, the heated surface initiates combustion of the gas. Fuel for combustion, such as natural gas, may be provided by a gas valve 128.

The products of combustion are exhausted outside of the building, and an inducer blower 132 may be turned on prior to ignition of the burner 120. In a high efficiency furnace, the products of combustion may not be hot enough to have sufficient buoyancy to exhaust via conduction. Therefore, the inducer blower 132 creates a draft to exhaust the products of combustion. The inducer blower 132 may remain running while the burner 120 is operating. In addition, the inducer blower 132 may continue running for a set period of time after the burner 120 turns off.

A single enclosure, which will be referred to as an air handler unit 136, may include the filter 104, the circulator blower 108, the control module 112, the burner 120, the heat exchanger 124, the inducer blower 132, an expansion valve 140, an evaporator 144, and a condensate pan 146. In various implementations, the air handler unit 136 includes an electrical heating device (not shown) instead of or in addition to the burner 120. When used in addition to the burner 120, the electrical heating device may provide backup or secondary heat.

In FIG. 1, the HVAC system includes a split air conditioning system. Refrigerant is circulated through a compressor 148, a condenser 152, the expansion valve 140, and the evaporator 144. The evaporator 144 is placed in series with the supply air so that when cooling is desired, the evaporator 144 removes heat from the supply air, thereby cooling the supply air. During cooling, the evaporator 144 is cold, which causes water vapor to condense. This water vapor is collected in the condensate pan 146, which drains or is pumped out.

A control module 156 receives a cool request from the control module 112 and controls the compressor 148 accordingly. The control module 156 also controls a condenser fan 160, which increases heat exchange between the condenser 152 and outside air. In such a split system, the compressor 148, the condenser 152, the control module 156, and the condenser fan 160 are generally located outside of the building, often in a single condensing unit 164.

In various implementations, the control module 156 may simply include a run capacitor, a start capacitor, and a contactor or relay. In fact, in certain implementations, the start capacitor may be omitted, such as when a scroll compressor instead of a reciprocating compressor is being used. The compressor 148 may be a variable-capacity compressor and may respond to a multiple-level cool request. For example, the cool request may indicate a mid-capacity call for cool or a high-capacity call for cool.

The electrical lines provided to the condensing unit 164 may include a 240 volt mains power line (not shown) and a 24 volt switched control line. The 24 volt control line may correspond to the cool request shown in FIG. 1. The 24 volt control line controls operation of the contactor. When the control line indicates that the compressor should be on, the contactor contacts close, connecting the 240 volt power supply to the compressor 148. In addition, the contactor may connect the 240 volt power supply to the condenser fan 160. In various implementations, such as when the condensing unit 164 is located in the ground as part of a geothermal system, the condenser fan 160 may be omitted. When the 240 volt mains power supply arrives in two legs, as is common in the U.S., the contactor may have two sets of contacts, and can be referred to as a double-pole single-throw switch.

Monitoring of operation of components in the condensing unit 164 and the air handler unit 136 has traditionally been performed by an expensive array of multiple discrete sensors that measure current individually for each component. For example, a first sensor may sense the current drawn by a motor, another sensor measures resistance or current flow of an igniter, and yet another sensor monitors a state of a gas valve. However, the cost of these sensors and the time required for installation of, and taking readings from, the sensors has made monitoring cost-prohibitive.

SUMMARY

A monitoring system for monitoring a heating, ventilation, and air conditioning (HVAC) system of a building includes a monitoring server. The monitoring server is configured to receive an aggregate control line current value from a monitoring device. The aggregate control line current value represents a total current flowing through control lines used by a thermostat to command the HVAC system. The monitoring server is configured to determine a commanded operating mode of the HVAC system in response to the aggregate control line current value. Operating modes of the HVAC system include at least one of an idle mode and an ON mode. The monitoring server is configured to analyze a system condition of the HVAC system based on the determined commanded operating mode.

In other features, the system condition includes at least one of a detected fault of the HVAC system and a predicted fault of the HVAC system. In other features, the monitoring server is configured to generate an alert for at least one of a customer and a contractor in response to determining presence of at least one of the detected fault and the predicted fault. In other features, the monitoring server is located remotely from the building. In other features, the monitoring device is installed at the building. The monitoring device is configured to measure the total current flowing through the control lines.

In other features, the monitoring device includes a current sensor that measures a first current flowing through a conductor supplying power to the thermostat. The monitoring device determines the aggregate control line current value based on the first current. In other features, the monitoring device includes a voltage sensor that measures a voltage on an output side of a transformer associated with the control lines. The monitoring device determines the aggregate control line current based on an apparent transformer ratio. The apparent transformer ratio is based on the measured voltage of the output side of the transformer and a voltage on an input side of the transformer.

In other features, the monitoring device includes a voltage sensor that measures a voltage associated with the control lines. The monitoring device determines the aggregate control line current based on the measured voltage. In other features, the system includes a second monitoring device. The second monitoring device includes a current sensor configured to measure an aggregate control line current consumed by an outdoor unit of the HVAC system. The monitoring server is configured to infer, in response to the commanded operating mode of the HVAC system being unknown, the commanded operating mode using the aggregate control line current consumed by the outdoor unit.

In other features, the ON mode encompasses multiple operating modes including at least two of the following: a fan only mode, a heating mode, a second stage heating mode, a cooling mode, a second stage cooling mode, an auxiliary heating mode, and an emergency mode. In other features, the monitoring server is configured to store a table of aggregate control line current values with respect to the operating modes of the HVAC system. The monitoring server is configured to determine the commanded operating mode of the HVAC system based on the table. In other features, the table includes an aggregate control line current value corresponding to each of the operating modes of the HVAC system.

In other features, a first current value is associated with a first upper limit and a first lower limit in the table and corresponds to a first operating mode. The monitoring server is configured to determine that the commanded operating mode of the HVAC system is the first operating mode in response to the received aggregate control line current being greater than or equal to the first lower limit and less than or equal to the first upper limit. In other features, the table is predefined upon commissioning of the HVAC system. In other features, the table is predefined based on a model number of the HVAC system. In other features, the monitoring server is configured to populate the table.

In other features, the monitoring server is configured to, in response to the commanded operating mode of the HVAC system being unknown, infer the commanded operating mode using additional data. In other features, the monitoring server is configured to store the inference along with the received aggregate control line current for future use. In other features, the additional data includes outside ambient temperature in a geographical region of the HVAC system. In other features, the additional data includes supply air temperature of the HVAC system. In other features, the additional data includes a refrigerant line temperature of the HVAC system.

In other features, the additional data includes a time of year. In other features, the additional data includes an aggregate current consumption of the HVAC system. In other features, the aggregate current consumption of the HVAC system includes all current drawn by components of either (i) an indoor enclosure of the HVAC system or (ii) an outdoor enclosure of the HVAC system. In other features, the additional data includes at least one of (i) a steady-state value of the aggregate current consumed by the indoor enclosure, and (ii) a time-domain or frequency-domain signature of the aggregate current consumed by the indoor enclosure.

A method of operating a monitoring system for a heating, ventilation, and air conditioning (HVAC) system of a building includes receiving an aggregate control line current value from a monitoring device. The aggregate control line current value represents a total current flowing through control lines used by a thermostat to command the HVAC system. The method includes determining a commanded operating mode of the HVAC system in response to the aggregate control line current value. Operating modes of the HVAC system include at least one of an idle mode and an ON mode. The method includes analyzing a system condition of the HVAC system based on the determined commanded operating mode.

In other features, the system condition includes at least one of a detected fault of the HVAC system and a predicted fault of the HVAC system. In other features, the method includes generating an alert for at least one of a customer and a contractor in response to determining presence of at least one of the detected fault and the predicted fault. In other features, the monitoring server is located remotely from the building.

In other features, the monitoring device is installed at the building. The method further includes measuring the total current flowing through the control lines using the monitoring device. In other features, the monitoring device includes a current sensor that measures a first current flowing through a conductor supplying power to the thermostat. The method further includes determining the aggregate control line current value based on the first current.

In other features, the monitoring device includes a voltage sensor that measures a voltage on an output side of a transformer associated with the control lines. The method further includes (i) determining an apparent transformer ratio based on the measured voltage of the output side of the transformer and a voltage on an input side of the transformer and (ii) determining the aggregate control line current based on the apparent transformer ratio. In other features, the monitoring device includes a voltage sensor that measures a voltage associated with the control lines. The method further includes determining the aggregate control line current based on the measured voltage.

In other features, the method includes measuring an aggregate control line current consumed by an outdoor unit of the HVAC system using a second monitoring device that includes a current sensor. The method includes, in response to the commanded operating mode of the HVAC system being unknown, inferring the commanded operating mode using the aggregate control line current consumed by the outdoor unit. In other features, the ON mode encompasses multiple operating modes including at least two of the following: a fan only mode, a heating mode, a second stage heating mode, a cooling mode, a second stage cooling mode, an auxiliary heating mode, and an emergency mode.

In other features, the method includes storing a table of aggregate control line current values with respect to the operating modes of the HVAC system, and determining the commanded operating mode of the HVAC system based on the table. In other features, the table includes an aggregate control line current value corresponding to each of the operating modes of the HVAC system.

In other features, a first current value is associated with a first upper limit and a first lower limit in the table and corresponds to a first operating mode. The method further includes determining that the commanded operating mode of the HVAC system is the first operating mode in response to the received aggregate control line current being greater than or equal to the first lower limit and less than or equal to the first upper limit.

In other features, the table is predefined upon commissioning of the HVAC system. In other features, the table is predefined based on a model number of the HVAC system. In other features, the method includes populating the table. In other features, the method includes, in response to the commanded operating mode of the HVAC system being unknown, inferring the commanded operating mode using additional data.

In other features, the method includes storing the inference along with the received aggregate control line current for future use. In other features, the additional data includes outside ambient temperature in a geographical region of the HVAC system. In other features, the additional data includes supply air temperature of the HVAC system. In other features, the additional data includes a refrigerant line temperature of the HVAC system. In other features, the additional data includes a time of year.

In other features, the additional data includes an aggregate current consumption of the HVAC system. In other features, the aggregate current consumption of the HVAC system includes all current drawn by components of either (i) an indoor enclosure of the HVAC system or (ii) an outdoor enclosure of the HVAC system. In other features, the additional data includes at least one of (i) a steady-state value of the aggregate current consumed by the indoor enclosure, and (ii) a time-domain or frequency-domain signature of the aggregate current consumed by the indoor enclosure.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings.

FIG. 4 is a table of example current values corresponding to operating modes of a particular HVAC system installation.

In the drawings, reference numbers may be reused to identify similar and/or identical elements.

DETAILED DESCRIPTION

According to the present disclosure, a monitoring system can be integrated with a residential or light commercial HVAC (heating, ventilation, or air conditioning) system of a building. The monitoring system can provide information on the status, maintenance, and efficiency of the HVAC system to customers and/or contractors associated with the building. For example, the building may be a single-family residence, and the customer may be the homeowner, a landlord, or a tenant. In other implementations, the building may be a light commercial building, and the customer may be the building owner, a tenant, or a property management company.

As used in this application, the term HVAC can encompass all environmental comfort systems in a building, including heating, cooling, humidifying, dehumidifying, and air exchanging and purifying, and covers devices such as furnaces, heat pumps, humidifiers, dehumidifiers, and air conditioners. HVAC systems as described in this application do not necessarily include both heating and air conditioning, and may instead have only one or the other.

In split HVAC systems with an air handler unit (often, located indoors) and a condensing unit (often, located outdoors), an air handler monitor module and a condensing monitor module, respectively, can be used. The air handler monitor module and the condensing monitor module may be integrated by the manufacturer of the HVAC system, may be added at the time of the installation of the HVAC system, and/or may be retrofitted to an existing HVAC system.

Figure 1:
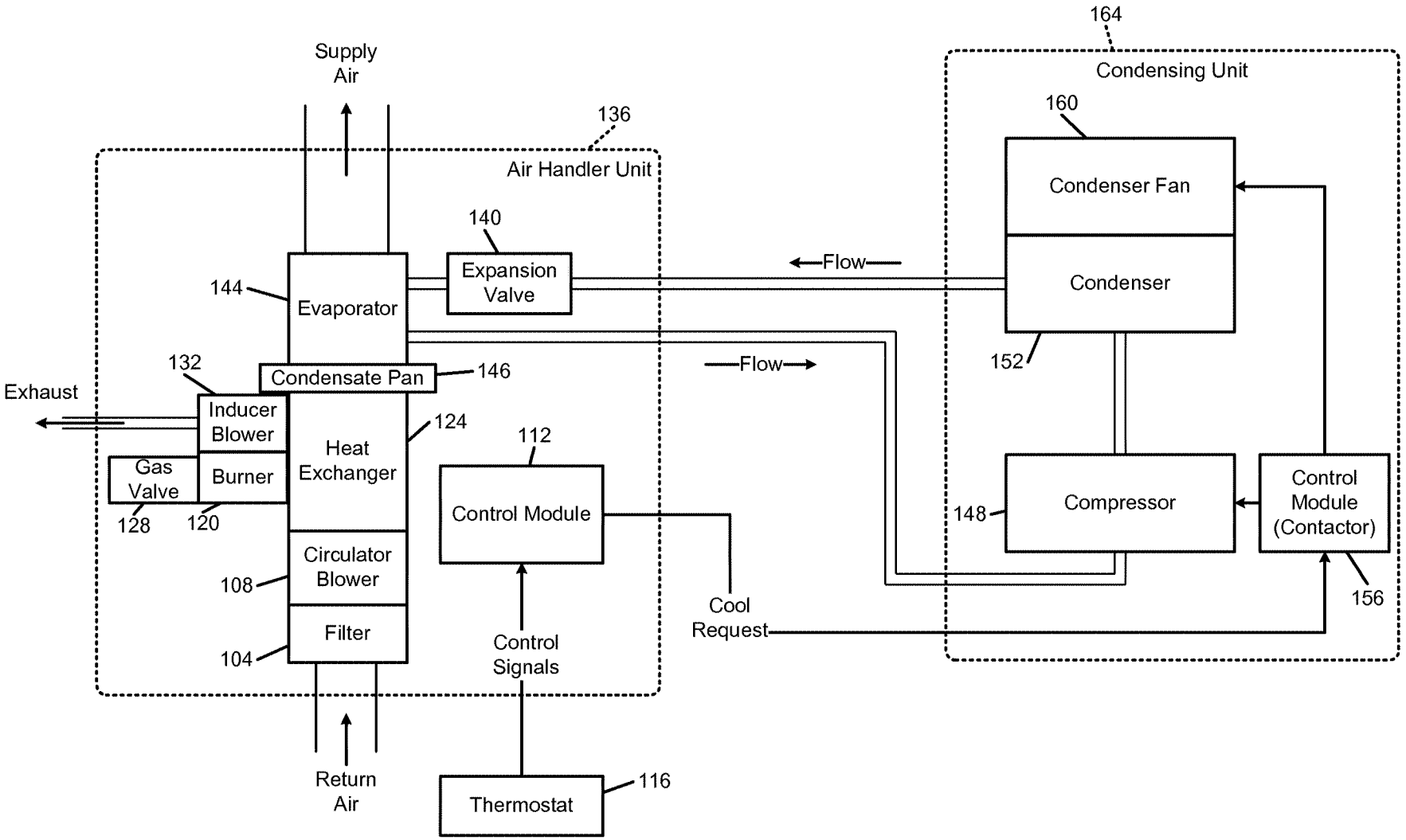
FIG. 1 Prior Art
FIG. 1 is a block diagram of an example HVAC system according to the prior art.

In heat pump systems, the function of the air handler unit and the condensing unit are reversed depending on the mode of the heat pump. As a result, although the present disclosure uses the terms air handler unit and condensing unit, the terms indoor unit and outdoor unit could be used instead in the context of a heat pump. The terms indoor unit and outdoor unit emphasize that the physical locations of the components stay the same while their roles change depending on the mode of the heat pump. A reversing valve selectively reverses the flow of refrigerant from what is shown in FIG. 1 depending on whether the system is heating the building or cooling the building. When the flow of refrigerant is reversed, the roles of the evaporator and condenser are reversed—i.e., refrigerant evaporation occurs in what is labeled the condenser while refrigerant condensation occurs in what is labeled as the evaporator.

The air handler monitor and condensing monitor modules monitor operating parameters of associated components of the HVAC system. For example, the operating parameters may include power supply current, power supply voltage, operating and ambient temperatures of inside and outside air, refrigerant temperatures at various points in the refrigerant loop, fault signals, control signals, and humidity of inside and outside air.

The principles of the present disclosure may be applied to monitoring other systems, such as a hot water heater, a boiler heating system, a refrigerator, a refrigeration case, a pool heater, a pool pump/filter, etc. As an example, the hot water heater may include an igniter, a gas valve (which may be operated by a solenoid), an igniter, an inducer blower, and a pump. The monitoring system may analyze aggregate current readings to assess operation of the individual components of the hot water heater.

The air handler monitor and condensing monitor modules may communicate data between each other, while one or both of the air handler monitor and condensing monitor modules upload data to a remote location. The remote location may be accessible via any suitable network, including the Internet.

The remote location includes one or more computers, which will be referred to as servers. The servers execute a monitoring system on behalf of a monitoring company. The monitoring system receives and processes the data from the air handler monitor and condensing monitor modules of customers who have such systems installed. The monitoring system can provide performance information, diagnostic alerts, and error messages to a customer and/or third parties, such as designated HVAC contractors.

A server of the monitoring system includes a processor and memory. The memory stores application code that processes data received from the air handler monitor and condensing monitor modules and determines existing and/or impending failures, as described in more detail below. The processor executes this application code and stores received data either in the memory or in other forms of storage, including magnetic storage, optical storage, flash memory storage, etc. While the term server is used in this application, the application is not limited to a single server.

A collection of servers may together operate to receive and process data from the air handler monitor and condensing monitor modules of multiple buildings. A load balancing algorithm may be used between the servers to distribute processing and storage. The present application is not limited to servers that are owned, maintained, and housed by a monitoring company. Although the present disclosure describes diagnostics and processing and alerting occurring in a remote monitoring system, some or all of these functions may be performed locally using installed equipment and/or customer resources, such as on a customer computer or computers.

Customers and/or HVAC contractors may be notified of current and predicted issues affecting effectiveness or efficiency of the HVAC system, and may receive notifications related to routine maintenance. The methods of notification may take the form of push or pull updates to an application, which may be executed on a smart phone or other mobile device or on a standard computer. Notifications may also be viewed using web applications or on local displays, such as on a thermostat or other displays located throughout the building or on a display (not shown) implemented in the air handler monitor module or the condensing monitor module. Notifications may also include text messages, emails, social networking messages, voicemails, phone calls, etc.

The air handler monitor and condensing monitor modules may each sense an aggregate current for the respective unit without measuring individual currents of individual components. The aggregate current data may be processed using frequency domain analysis, statistical analysis, and state machine analysis to determine operation of individual components based on the aggregate current data. This processing may happen partially or entirely in a server environment, remote from the customer's building or residence.

The frequency domain analysis may allow individual contributions of HVAC system components to be determined. Some of the advantages of using an aggregate current measurement may include reducing the number of current sensors that would otherwise be necessary to monitor each of the HVAC system components. This reduces bill of materials costs, as well as installation costs and potential installation problems. Further, providing a single time-domain current stream may reduce the amount of bandwidth necessary to upload the current data. Nevertheless, the present disclosure could also be used with additional current sensors.

Based on measurements from the air handler monitor and condensing monitor modules, the monitoring company can determine whether HVAC components are operating at their peak performance and can advise the customer and the contractor when performance is reduced. This performance reduction may be measured for the system as a whole, such as in terms of efficiency, and/or may be monitored for one or more individual components.

In addition, the monitoring system may detect and/or predict failures of one or more components of the system. When a failure is detected, the customer can be notified and potential remediation steps can be taken immediately. For example, components of the HVAC system may be shut down to prevent or minimize damage, such as water damage, to HVAC components. The contractor can also be notified that a service call will be required. Depending on the contractual relationship between the customer and the contractor, the contractor may immediately schedule a service call to the building.

The monitoring system may provide specific information to the contractor, including identifying information of the customer's HVAC system, including make and model numbers, as well as indications of the specific part numbers that appear to be failing. Based on this information, the contractor can allocate the correct repair personnel that have experience with the specific HVAC system and/or component. In addition, the service technician is able to bring replacement parts, avoiding return trips after diagnosis.

Depending on the severity of the failure, the customer and/or contractor may be advised of relevant factors in determining whether to repair the HVAC system or replace some or all of the components of the HVAC system. For example only, these factors may include relative costs of repair versus replacement, and may include quantitative or qualitative information about advantages of replacement equipment. For example, expected increases in efficiency and/or comfort with new equipment may be provided. Based on historical usage data and/or electricity or other commodity prices, the comparison may also estimate annual savings resulting from the efficiency improvement.

As mentioned above, the monitoring system may also predict impending failures. This allows for preventative maintenance and repair prior to an actual failure. Alerts regarding detected or impending failures reduce the time when the HVAC system is out of operation and allows for more flexible scheduling for both the customer and contractor. If the customer is out of town, these alerts may prevent damage from occurring when the customer is not present to detect the failure of the HVAC system. For example, failure of heat in winter may lead to pipes freezing and bursting.

Alerts regarding potential or impending failures may specify statistical timeframes before the failure is expected. For example only, if a sensor is intermittently providing bad data, the monitoring system may specify an expected amount of time before it is likely that the sensor effectively stops working due to the prevalence of bad data. Further, the monitoring system may explain, in quantitative or qualitative terms, how the current operation and/or the potential failure will affect operation of the HVAC system. This enables the customer to prioritize and budget for repairs.

For the monitoring service, the monitoring company may charge a periodic rate, such as a monthly rate. This charge may be billed directly to the customer and/or may be billed to the contractor. The contractor may pass along these charges to the customer and/or may make other arrangements, such as by requiring an up-front payment upon installation and/or applying surcharges to repairs and service visits.

For the air handler monitor and condensing monitor modules, the monitoring company or contractor may charge the customer the equipment cost, including the installation cost, at the time of installation and/or may recoup these costs as part of the monthly fee. Alternatively, rental fees may be charged for the air handler monitor and condensing monitor modules, and once the monitoring service is stopped, the air handler monitor and condensing monitor modules may be returned.

The monitoring service may allow the customer and/or contractor to remotely monitor and/or control HVAC components, such as setting temperature, enabling or disabling heating and/or cooling, etc. In addition, the customer may be able to track energy usage, cycling times of the HVAC system, and/or historical data. Efficiency and/or operating costs of the customer's HVAC system may be compared against HVAC systems of neighbors, whose buildings will be subject to the same or similar environmental conditions. This allows for direct comparison of HVAC system and overall building efficiency because environmental variables, such as temperature and wind, are controlled.

The installer can provide information to the remote monitoring system including identification of control lines that were connected to the air handler monitor module and condensing monitor module. In addition, information such as the HVAC system type, year installed, manufacturer, model number, BTU rating, filter type, filter size, tonnage, etc.

In addition, because the condensing unit may have been installed separately from the furnace, the installer may also record and provide to the remote monitoring system the manufacturer and model number of the condensing unit, the year installed, the refrigerant type, the tonnage, etc. Upon installation, baseline tests are run. For example, this may include running a heating cycle and a cooling cycle, which the remote monitoring system records and uses to identify initial efficiency metrics. Further, baseline profiles for current, power, and frequency domain current can be established.

The server may store baseline data for the HVAC system of each building. The baselines can be used to detect changes indicating impending or existing failures. For example only, frequency-domain current signatures of failures of various components may be pre-programmed, and may be updated based on observed evidence from contractors. For example, once a malfunction in an HVAC system is recognized, the monitoring system may note the frequency data leading up to the malfunction and correlate that frequency signature with frequency signatures associated with potential causes of the malfunction. For example only, a computer learning system, such as a neural network or a genetic algorithm, may be used to refine frequency signatures. The frequency signatures may be unique to different types of HVAC systems but may share common characteristics. These common characteristics may be adapted based on the specific type of HVAC system being monitored.

The installer may collect a device fee, an installation fee, and/or a subscription fee from the customer. In various implementations, the subscription fee, the installation fee, and the device fee may be rolled into a single system fee, which the customer pays upon installation. The system fee may include the subscription fee for a set number of years, such as 1, 2, 5, or 10, or may be a lifetime subscription, which may last for the life of the home or the ownership of the building by the customer.

The monitoring system can be used by the contractor during and after installation and during and after repair (i) to verify operation of the air handler monitor and condensing monitor modules, as well as (ii) to verify correct installation of the components of the HVAC system. In addition, the customer may review this data in the monitoring system for assurance that the contractor correctly installed and configured the HVAC system. In addition to being uploaded to the remote monitoring service (also referred to as the cloud), monitored data may be transmitted to a local device in the building. For example, a smartphone, laptop, or proprietary portable device may receive monitoring information to diagnose problems and receive real-time performance data. Alternatively, data may be uploaded to the cloud and then downloaded onto a local computing device, such as via the Internet from an interactive web site.

The historical data collected by the monitoring system may allow the contractor to properly specify new HVAC components and to better tune configuration, including dampers and set points of the HVAC system. The information collected may be helpful in product development and assessing failure modes. The information may be relevant to warranty concerns, such as determining whether a particular problem is covered by a warranty. Further, the information may help to identify conditions, such as unauthorized system modifications, that could potentially void warranty coverage.

Original equipment manufacturers may subsidize partially or fully the cost of the monitoring system and air handler and condensing monitor modules in return for access to this information. Installation and service contractors may also subsidize some or all of these costs in return for access to this information, and for example, in exchange for being recommended by the monitoring system. Based on historical service data and customer feedback, the monitoring system may provide contractor recommendations to customers.

Figure 2A:
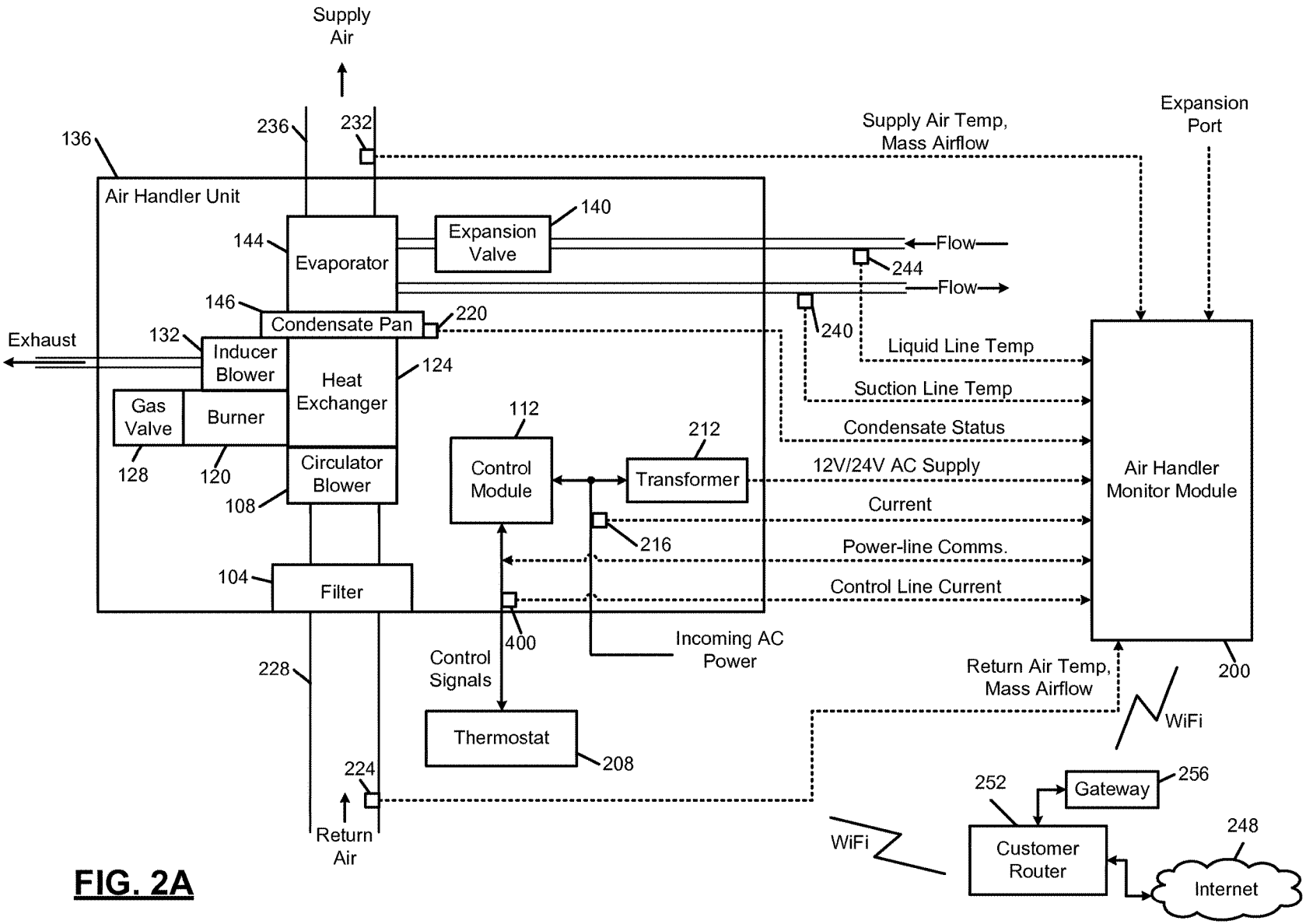
FIG. 2A is a functional block diagram of an example HVAC system including an implementation of an air handler monitor module.
Figure 2B:
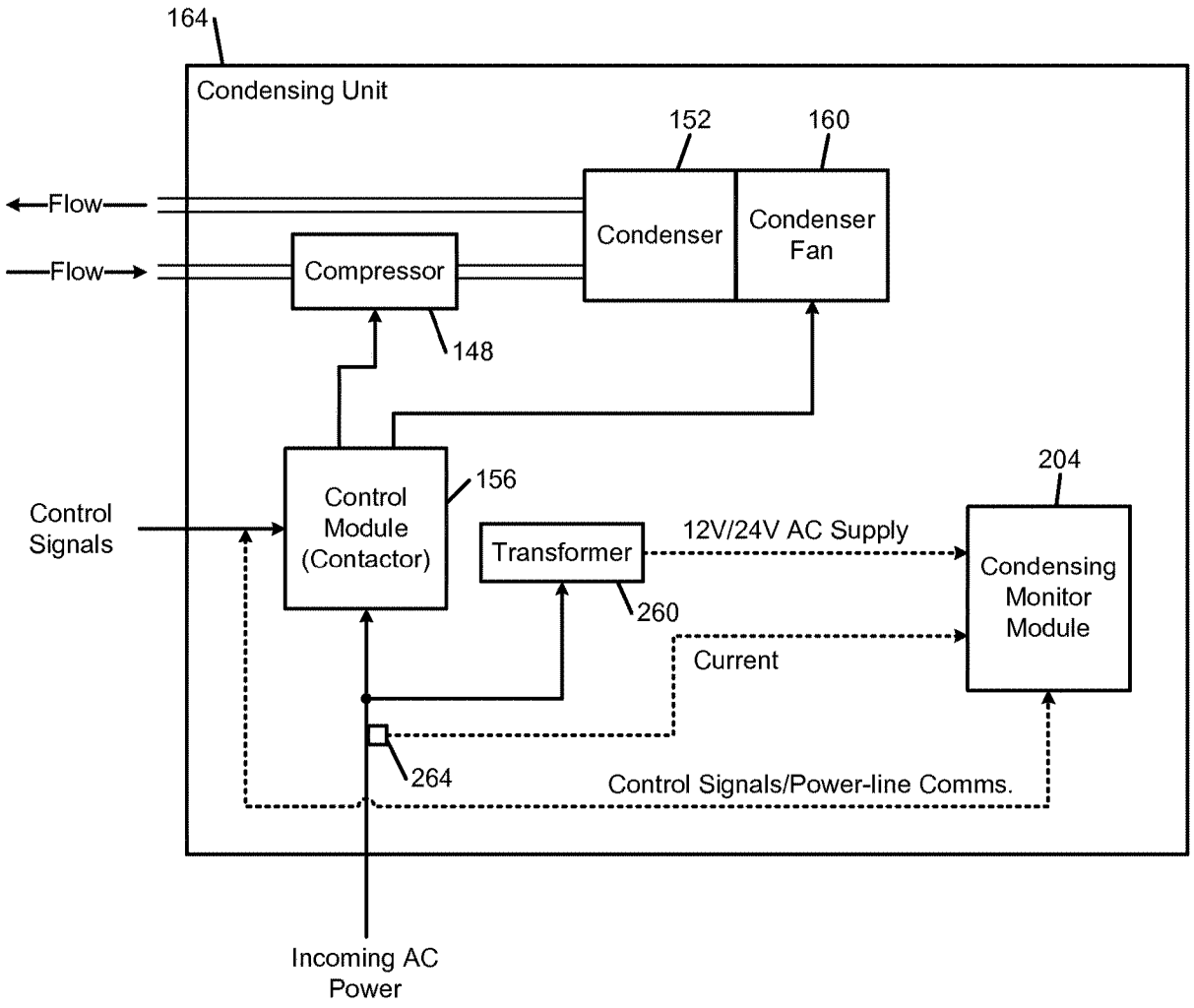
FIG. 2B is a functional block diagram of an example HVAC system including an implementation of a condensing monitor module.

FIGS. 2A-2B are functional block diagrams of an example monitoring system associated with an HVAC system of a building. The air handler unit 136 of FIG. 1 is shown for reference. Because the monitoring systems of the present disclosure can be used in retrofit applications, elements of the air handler unit 136 may remain unmodified. An air handler monitor module 200 and a condensing monitor module 204 can be installed in an existing system without needing to replace the original thermostat 116 shown in FIG. 1. To enable certain additional functionality, however, such as WiFi thermostat control and/or thermostat display of alert messages, the thermostat 116 of FIG. 1 may be replaced with a thermostat 208 having networking capability.

In many systems, the air handler unit 136 is located inside the building, while the condensing unit 164 is located outside the building. The present disclosure is not limited, and applies to other systems including, as examples only, systems where the components of the air handler unit 136 and the condensing unit 164 are located in close proximity to each other or even in a single enclosure. The single enclosure may be located inside or outside of the building. In various implementations, the air handler unit 136 may be located in a basement, garage, or attic. In ground source systems, where heat is exchanged with the earth, the air handler unit 136 and the condensing unit 164 may be located near the earth, such as in a basement, crawlspace, garage, or on the first floor, such as when the first floor is separated from the earth by only a concrete slab.

In FIG. 2A, the air handler monitor module 200 is shown external to the air handler unit 136, although the air handler monitor module 200 may be physically located outside of, in contact with, or even inside of an enclosure, such as a sheet metal casing, of the air handler unit 136.

When installing the air handler monitor module 200 in the air handler unit 136, power is provided to the air handler monitor module 200. For example, a transformer 212 can be connected to an AC line in order to provide AC power to the air handler monitor module 200. The air handler monitor module 200 may measure voltage of the incoming AC line based on this transformed power supply. For example, the transformer 212 may be a 10-to-1 transformer and therefore provide either a 12V or 24V AC supply to the air handler monitor module 200 depending on whether the air handler unit 136 is operating on nominal 120 volt or nominal 240 volt power. The air handler monitor module 200 then receives power from the transformer 212 and determines the AC line voltage based on the power received from the transformer 212.

For example, frequency, amplitude, RMS voltage, and DC offset may be calculated based on the measured voltages. In situations where 3-phase power is used, the order of the phases may be determined. Information about when the voltage crosses zero may be used to synchronize various measurements and to determine frequency of the AC power based on counting the number of zero crossings within a predetermine time period.

A current sensor 216 measures incoming current to the air handler unit 136. The current sensor 216 may include a current transformer that snaps around one power lead of the incoming AC power. The current sensor 216 may alternatively include a current shunt or a hall effect device. In various implementations, a power sensor (not shown) may be used in addition to or in place of the current sensor 216.

In various other implementations, electrical parameters (such as voltage, current, and power factor) may be measured at a different location, such as at an electrical panel providing power to the building from the electrical utility.

For simplicity of illustration, the control module 112 is not shown to be connected to the various components and sensors of the air handler unit 136. In addition, routing of the AC power to various powered components of the air handler unit 136, such as the circulator blower 108, the gas valve 128, and the inducer blower 132, are also not shown for simplicity. The current sensor 216 measures the current entering the air handler unit 136 and therefore represents an aggregate current of the current-consuming components of the air handler unit 136.

The control module 112 controls operation in response to signals from a thermostat 208 received over control lines. The air handler monitor module 200 monitors the control lines. The control lines may include a call for cool, a call for heat, and a call for fan. The control lines may include a line corresponding to a state of a reversing valve in heat pump systems.

The control lines may further carry calls for secondary heat and/or secondary cooling, which may be activated when the primary heating or primary cooling is insufficient. In dual fuel systems, such as systems operating from either electricity or natural gas, control signals related to the selection of the fuel may be monitored. Further, additional status and error signals may be monitored, such as a defrost status signal, which may be asserted when the compressor is shut off and a defrost heater operates to melt frost from an evaporator.

The control lines may be monitored by attaching leads to terminal blocks at the control module 112 at which the fan and heat signals are received. These terminal blocks may include additional connections where leads can be attached between these additional connections and the air handler monitor module 200. Alternatively, leads from the air handler monitor module 200 may be attached to the same location as the fan and heat signals, such as by putting multiple spade lugs underneath a signal screw head.

In various implementations, the cool signal from the thermostat 208 may be disconnected from the control module 112 and attached to the air handler monitor module 200. The air handler monitor module 200 can then provide a switched cool signal to the control module 112. This allows the air handler monitor module 200 to interrupt operation of the air conditioning system, such as upon detection of water by one of the water sensors. The air handler monitor module 200 may also interrupt operation of the air conditioning system based on information from the condensing monitor module 204, such as detection of a locked rotor condition in the compressor.

A condensate sensor 220 measures condensate levels in the condensate pan 146. If a level of condensate gets too high, this may indicate a plug or clog in the condensate pan 146 or a problem with hoses or pumps used for drainage from the condensate pan 146. The condensate sensor 220 may be installed along with the air handler monitor module 200 or may already be present. When the condensate sensor 220 is already present, an electrical interface adapter may be used to allow the air handler monitor module 200 to receive the readings from the condensate sensor 220. Although shown in FIG. 2A as being internal to the air handler unit 136, access to the condensate pan 146, and therefore the location of the condensate sensor 220, may be external to the air handler unit 136.

Additional water sensors, such as a conduction (wet floor) sensor may also be installed. The air handler unit 136 may be located on a catch pan, especially in situations where the air handler unit 136 is located above living space of the building. The catch pan may include a float switch. When enough liquid accumulates in the catch pan, the float switch provides an over-level signal, which may be sensed by the air handler monitor module 200.

A return air sensor 224 is located in a return air plenum 228. The return air sensor 224 may measure temperature and may also measure mass airflow. In various implementations, a thermistor may be multiplexed as both a temperature sensor and a hot wire mass airflow sensor. In various implementations, the return air sensor 224 is upstream of the filter 104 but downstream of any bends in the return air plenum 228.

A supply air sensor 232 is located in a supply air plenum 236. The supply air sensor 232 may measure air temperature and may also measure mass airflow. The supply air sensor 232 may include a thermistor that is multiplexed to measure both temperature and, as a hot wire sensor, mass airflow. In various implementations, such as is shown in FIG. 2A, the supply air sensor 232 may be located downstream of the evaporator 144 but upstream of any bends in the supply air plenum 236.

A differential pressure reading may be obtained by placing opposite sensing inputs of a differential pressure sensor (not shown) in the return air plenum 228 and the supply air plenum 236, respectively. For example only, these sensing inputs may be collocated or integrated with the return air sensor 224 and the supply air sensor 232, respectively. In various implementations, discrete pressure sensors may be placed in the return air plenum 228 and the supply air plenum 236. A differential pressure value can then be calculated by subtracting the individual pressure values.

The air handler monitor module 200 also receives a suction line temperature from a suction line temperature sensor 240. The suction line temperature sensor 240 measures refrigerant temperature in the refrigerant line between the evaporator 144 of FIG. 2A and the compressor 148 of FIG. 2B. A liquid line temperature sensor 244 measures the temperature of refrigerant in a liquid line traveling from the condenser 152 of FIG. 2B to the expansion valve 140 of FIG. 2A.

The air handler monitor module 200 may include one or more expansion ports to allow for connection of additional sensors and/or to allow connection to other devices, such as a home security system, a proprietary handheld device for use by contractors, or a portable computer.

The air handler monitor module 200 also monitors control signals from the thermostat 208. Because one or more of these control signals is also transmitted to the condensing unit 164 of FIG. 2B, these control signals can be used for communication between the air handler monitor module 200 and the condensing monitor module 204 of FIG. 2B.

The air handler monitor module 200 may transmit frames of data corresponding to periods of time. For example only, 7.5 frames may span one second (i.e., 0.1333 seconds per frame). Each frame of data may include voltage, current, temperatures, control line status, and water sensor status. Calculations may be performed for each frame of data, including averages, powers, RMS, and FFT. Then the frame is transmitted to the monitoring system.

The voltage and current signals may be sampled by an analog-to-digital converter at a certain rate, such as 1920 samples per second. The frame length may be measured in terms of samples. When a frame is 256 samples long, at a sample rate of 1920 samples per second, there will be 7.5 frames per second.

The sampling rate of 1920 Hz has a Nyquist frequency of 960 Hz and therefore allows an FFT bandwidth of up to approximately 960 Hz. An FFT limited to the time span of a single frame may be calculated for each frame. Then, for that frame, instead of transmitting all of the raw current data, only statistical data (such as average current) and frequency-domain data are transmitted.

This gives the monitoring system current data having a 7.5 Hz resolution, and gives frequency-domain data with approximately the 960 Hz bandwidth. The time-domain current and/or the derivative of the time-domain current may be analyzed to detect impending or existing failures. In addition, the current and/or the derivative may be used to determine which set of frequency-domain data to analyze. For example, certain time-domain data may indicate the approximate window of activation of a hot surface igniter, while frequency-domain data is used to assess the state of repair of the hot surface igniter.

In various implementations, the air handler monitor module 200 may only transmit frames during certain periods of time. These periods may be critical to operation of the HVAC system. For example, when thermostat control lines change, the air handler monitor module 200 may record data and transmit frames for a predetermined period of time after that transition. Then, if the HVAC system is operating, the air handler monitor module 200 may intermittently record data and transmit frames until operation of the HVAC system has completed.

The air handler monitor module 200 transmits data measured by both the air handler monitor module 200 itself and the condensing monitor module 204 over a wide area network 248, such as the Internet (referred to as the Internet 248). The air handler monitor module 200 may access the Internet 248 using a router 252 of the customer. The customer router 252 may already be present to provide Internet access to other devices (not shown) within the building, such as a customer computer and/or various other devices having Internet connectivity, such as a DVR (digital video recorder) or a video gaming system.

The air handler monitor module 200 communicates with the customer router 252 using a proprietary or standardized, wired or wireless protocol, such as Bluetooth, ZigBee (IEEE 802.15.4), 900 Megahertz, 2.4 Gigahertz, WiFi (IEEE 802.11). In various implementations, a gateway 256 is implemented, which creates a wireless network with the air handler monitor module 200. The gateway 256 may interface with the customer router 252 using a wired or wireless protocol, such as Ethernet (IEEE 802.3).

The thermostat 208 may also communicate with the customer router 252 using WiFi. Alternatively, the thermostat 208 may communicate with the customer router 252 via the gateway 256. In various implementations, the air handler monitor module 200 and the thermostat 208 do not communicate directly. However, because they are both connected through the customer router 252 to a remote monitoring system, the remote monitoring system may allow for control of one based on inputs from the other. For example, various faults identified based on information from the air handler monitor module 200 may cause the remote monitoring system to adjust temperature set points of the thermostat 208 and/or display warning or alert messages on the thermostat 208.

In various implementations, the transformer 212 may be omitted, and the air handler monitor module 200 may include a power supply that is directly powered by the incoming AC power. Further, power-line communications may be conducted over the AC power line instead of over a lower-voltage HVAC control line.

In various implementations, the current sensor 400 may be omitted, and instead a voltage sensor (not shown) may be used. The voltage sensor measures the voltage of an output of a transformer internal to the control module 112, the internal transformer providing the power (e.g., 24 Volts) for the control signals. The air handler monitor module 200 may measure the voltage of the incoming AC power and calculate a ratio of the voltage input to the internal transformer to the voltage output from the internal transformer. As the current load on the internal transformer increases, the impedance of the internal transformer causes the voltage of the output power to decrease. Therefore, the current draw from the internal transformer can be inferred from the measured ratio (also called an apparent transformer ratio). The inferred current draw may be used in place of the measured aggregate current draw described in the present disclosure.

In FIG. 2B, the condensing monitor module 204 is installed in the condensing unit 164. A transformer 260 converts incoming AC voltage into a stepped-down voltage for powering the condensing monitor module 204. In various implementations, the transformer 260 may be a 10-to-1 transformer. A current sensor 264 measures current entering the condensing unit 164. The condensing monitor module 204 may also measure voltage from the supply provided by the transformer 260. Based on measurements of the voltage and current, the condensing monitor module 204 may calculate power and/or may determine power factor.

A liquid line temperature sensor 266 measures the temperature of refrigerant traveling from the condenser 152 to the air handler unit 136. In various implementations, the liquid line temperature sensor 266 is located prior to any filter-drier, such as the filter-drier 154 of FIG. 2A. In normal operation, the liquid line temperature sensor 266 and the liquid line temperature sensor 246 of FIG. 2A may provide similar data, and therefore one of the liquid line temperature sensors 246 or 266 may be omitted. However, having both of the liquid line temperature sensors 246 and 266 may allow for certain problems to be diagnosed, such as a kink or other restriction in the refrigerant line between the air handler unit 136 and the condensing unit 164.

In various implementations, the condensing monitor module 204 may receive ambient temperature data from a temperature sensor (not shown). When the condensing monitor module 204 is located outdoors, the ambient temperature represents an outside ambient temperature. The temperature sensor supplying the ambient temperature may be located outside of an enclosure of the condensing unit 164. Alternatively, the temperature sensor may be located within the enclosure, but exposed to circulating air. In various implementations the temperature sensor may be shielded from direct sunlight and may be exposed to an air cavity that is not directly heated by sunlight. Alternatively or additionally, online (including Internet-based) weather data based on geographical location of the building may be used to determine sun load, outside ambient air temperature, precipitation, and humidity.

In various implementations, the condensing monitor module 204 may receive refrigerant temperature data from refrigerant temperature sensors (not shown) located at various points, such as before the compressor 148 (referred to as a suction line temperature), after the compressor 148 (referred to as a compressor discharge temperature), after the condenser 152 (referred to as a liquid line out temperature), and/or at one or more points along a coil of the condenser 152. The location of temperature sensors may be dictated by a physical arrangement of the condenser coils. Additionally or alternatively to the liquid line out temperature sensor, a liquid line in temperature sensor may be used. An approach temperature may be calculated, which is a measure of how close the condenser 152 has been able to bring the liquid line out temperature to the ambient air temperature.

During installation, the location of the temperature sensors may be recorded. Additionally or alternatively, a database may be maintained that specifies where temperature sensors are placed. This database may be referenced by installers and may allow for accurate remote processing of the temperature data. The database may be used for both air handler sensors and compressor/condenser sensors. The database may be prepopulated by the monitoring company or may be developed by trusted installers, and then shared with other installation contractors.

As described above, the condensing monitor module 204 may communicate with the air handler monitor module 200 over one or more control lines from the thermostat 208. In these implementations, data from the condensing monitor module 204 is transmitted to the air handler monitor module 200, which in turn uploads the data over the Internet 248.

In various implementations, the transformer 260 may be omitted, and the condensing monitor module 204 may include a power supply that is directly powered by the incoming AC power. Further, power-line communications may be conducted over the AC power line instead of over a lower-voltage HVAC control line.

Figure 2C:
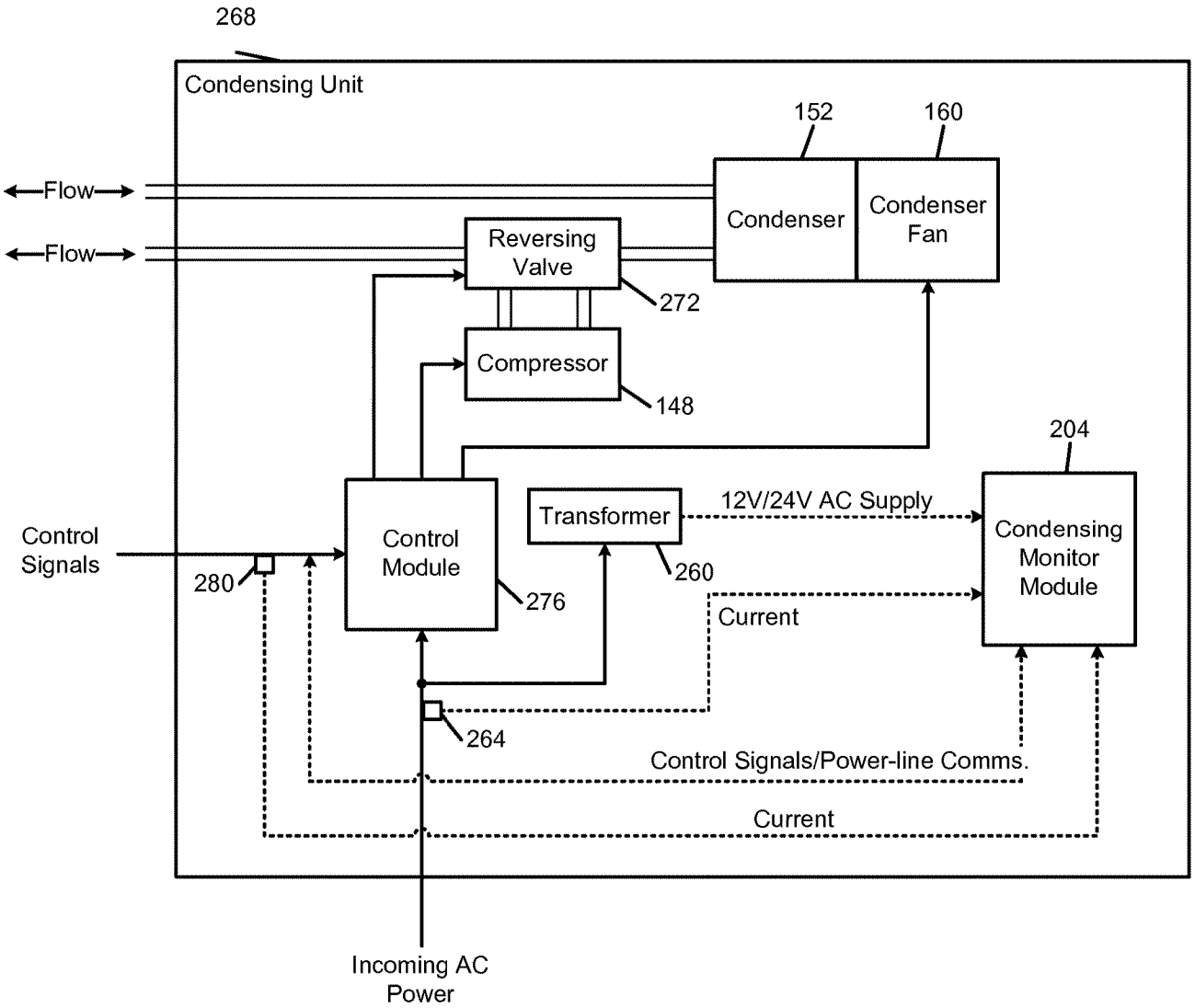
FIG. 2C is a functional block diagram of an example HVAC system based on a heat pump.

In FIG. 2C, an example condensing unit 268 is shown for a heat pump implementation. The condensing unit 268 may be configured similarly to the condensing unit 164 of FIG. 2B. Similarly to FIG. 2B, the transformer 260 may be omitted in various implementations. Although referred to as the condensing unit 268, the mode of the heat pump determines whether the condenser 152 of the condensing unit 268 is actually operating as a condenser or as an evaporator. A reversing valve 272 is controlled by a control module 276 and determines whether the compressor 148 discharges compressed refrigerant toward the condenser 152 (cooling mode) or away from the condenser 152 (heating mode).

In various implementations, a current sensor 280 is implemented to measure one or more currents of the control signals. The current sensor 280 may measure an aggregate current of all the control lines arriving at the condensing unit 268. The aggregate current may be obtained by measuring the current of a common control return conductor. The aggregate current measured by the current sensor 280 may be used to determine the state of multiple heat pump control signals, such as signals that control operation of defrosting functions and the reversing valve. The aggregate current measured by the current sensor 280 may also be used to determine the state of calls for varying levels of compressor capacity. While not shown, the current sensor 280 may similarly be installed in the condensing unit 164.

Figure 3:
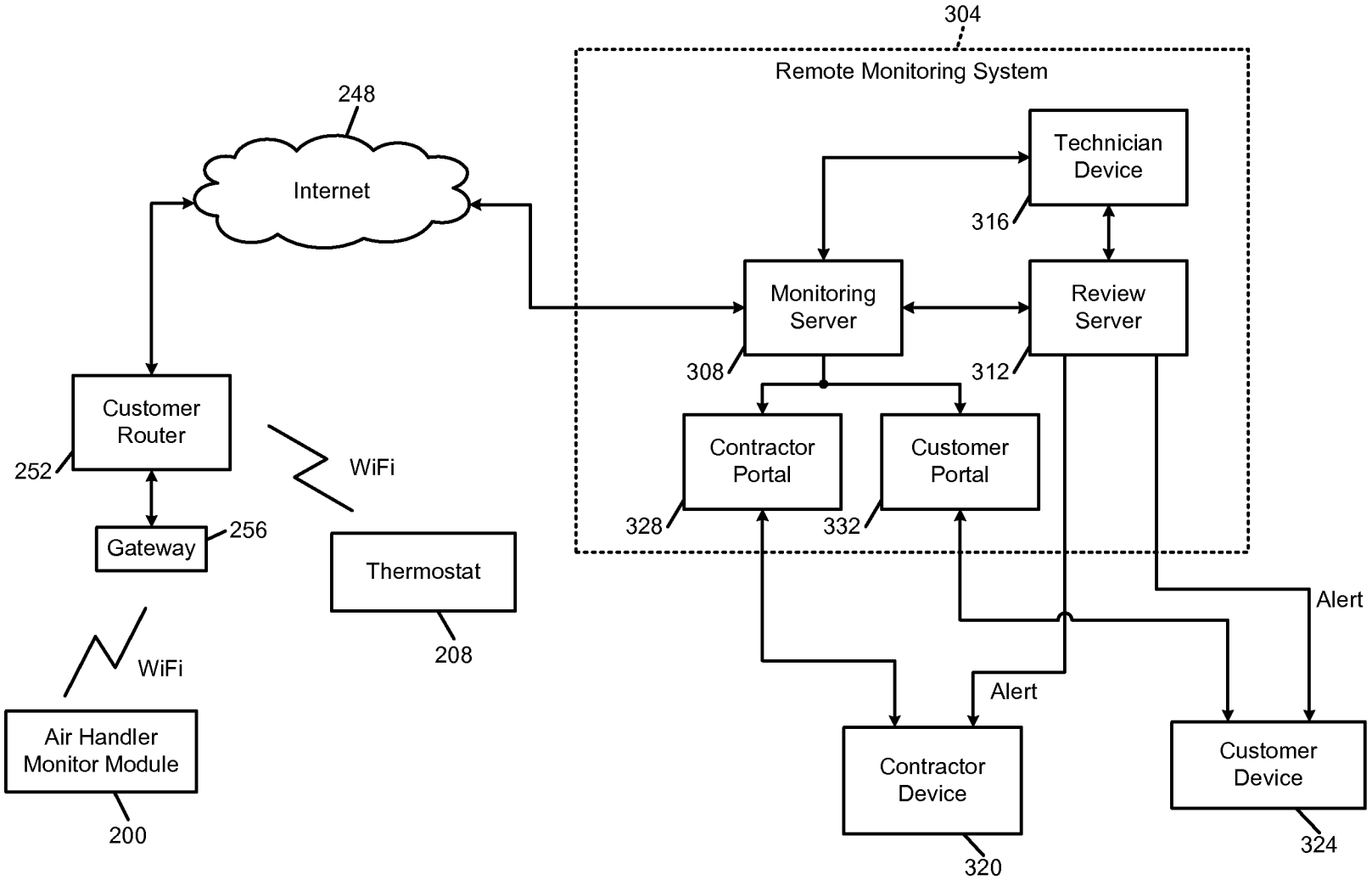
FIG. 3 is a high level functional block diagram of an example system including an implementation of a remote monitoring system.

In FIG. 3, the air handler monitor module 200 and the thermostat 208 are shown communicating, using the customer router 252, with a remote monitoring system 304 via the Internet 248. In other implementations, the condensing monitor module 204 may transmit data from the air handler monitor module 200 and the condensing monitor module 204 to an external wireless receiver. The external wireless receiver may be a proprietary receiver for a neighborhood in which the building is located, or may be an infrastructure receiver, such as a metropolitan area network (such as WiMAX), a WiFi access point, or a mobile phone base station.

The remote monitoring system 304 includes a monitoring server 308 that receives data from the air handler monitor module 200 and the thermostat 208 and maintains and verifies network continuity with the air handler monitor module 200. The monitoring server 308 executes various algorithms to identify problems, such as failures or decreased efficiency, and to predict impending faults.

The monitoring server 308 may notify a review server 312 when a problem is identified or a fault is predicted. This programmatic assessment may be referred to as an advisory. Some or all advisories may be triaged by a technician to reduce false positives and potentially supplement or modify data corresponding to the advisory. For example, a technician device 316 operated by a technician is used to review the advisory and to monitor data (in various implementations, in real-time) from the air handler monitor module 200 via the monitoring server 308.

The technician using the technician device 316 reviews the advisory. If the technician determines that the problem or fault is either already present or impending, the technician instructs the review server 312 to send an alert to either or both of a contractor device 320 or a customer device 324. The technician may determine that, although a problem or fault is present, the cause is more likely to be something different than specified by the automated advisory. The technician can therefore issue a different alert or modify the advisory before issuing an alert based on the advisory. The technician may also annotate the alert sent to the contractor device 320 and/or the customer device 324 with additional information that may be helpful in identifying the urgency of addressing the alert and presenting data that may be useful for diagnosis or troubleshooting.

In various implementations, minor problems may be reported to the contractor device 320 only so as not to alarm the customer or inundate the customer with alerts. Whether the problem is considered to be minor may be based on a threshold. For example, an efficiency decrease greater than a predetermined threshold may be reported to both the contractor and the customer, while an efficiency decrease less than the predetermined threshold is reported to only the contractor.

In some circumstances, the technician may determine that an alert is not warranted based on the advisory. The advisory may be stored for future use, for reporting purposes, and/or for adaptive learning of advisory algorithms and thresholds. In various implementations, a majority of generated advisories may be closed by the technician without sending an alert.

Based on data collected from advisories and alerts, certain alerts may be automated. For example, analyzing data over time may indicate that whether a certain alert is sent by a technician in response to a certain advisory depends on whether a data value is on one side of a threshold or another. A heuristic can then be developed that allows those advisories to be handled automatically without technician review. Based on other data, it may be determined that certain automatic alerts had a false positive rate over a threshold. These alerts may be put back under the control of a technician.

In various implementations, the technician device 316 may be remote from the remote monitoring system 304 but connected via a wide area network. For example only, the technician device 316 may include a computing device such as a laptop, desktop, or tablet.

With the contractor device 320, the contractor can access a contractor portal 328, which provides historical and real-time data from the air handler monitor module 200. The contractor using the contractor device 320 may also contact the technician using the technician device 316. The customer using the customer device 324 may access a customer portal 332 in which a graphical view of the system status as well as alert information is shown. The contractor portal 328 and the customer portal 332 may be implemented in a variety of ways according to the present disclosure, including as an interactive web page, a computer application, and/or an app for a smartphone or tablet.

In various implementations, data shown by the customer portal may be more limited and/or more delayed when compared to data visible in the contractor portal 328. In various implementations, the contractor device 320 can be used to request data from the air handler monitor module 200, such as when commissioning a new installation.

In various implementations, some of all of the functionality of the remote monitoring system 304 may be local instead of remote from the building. For example only, some or all of the functionality may be integrated with the air handler monitor module 200 or the condensing monitor module 204. Alternatively, a local controller may implement some of all of the functionality of the remote monitoring system 304.

Detection of various faults may require knowledge of which mode the HVAC system is operating in, and more specifically, which mode has been commanded by the thermostat. A heating fault may be identified when, for a given call for heat pattern, the supply/return air temperature split indicates insufficient heating. The threshold may be set at a predetermined percentage of the expected supply/return air temperature split.

A heating shutdown fault may be determined when a temperature split rises to within an expected range but then falls below the expected range. This may indicate that one or more of the pressure sensors has caused the heating to stop. As these shutdowns become more frequent, a more severe fault may be declared, indicating that the heater may soon fail to provide adequate heat for the conditioned space because the heater is repeatedly shutting down.

When a call for heat is made, the furnace will progress through a sequence of states. For example only, the sequence may begin with activating the inducer blower, opening the gas valve, igniting the gas, and turning on the circulator blower. Each of these states may be detectable in current data, although frequency-domain as well as time-domain data may be necessary to reliably determine certain states. When this sequence of states appears to indicate that the furnace is restarting, a fault may be declared. A furnace restart may be detected when the measured current matches a baseline current profile for a certain number of states and then diverges from the baseline current profile for the next state or states.

Furnace restarts may occur occasionally for various reasons, but as the number and frequency of furnace restart events increases, an eventual fault is predicted. For example only, if 50% of calls for heat involve one or more furnace restarts, a fault may be declared indicating that soon the furnace may fail to start altogether or may require so many restarts that sufficient heating will not be available.

An overheating fault may be declared when a temperature exceeds an expected value, such a baseline value, by more than a predetermined amount. For example, when the supply/return air temperature split is greater than a predetermined threshold, the heat exchanger may be operating at too high of a temperature.

A flame rollout switch is a safety device that detects overly high burner assembly temperatures, which may be caused by a reduction in airflow, such as a restricted flue. A fault in the flame rollout switch may be diagnosed based on states of the furnace sequence, as determined by measured current. For example, a trip of the flame rollout switch may generally occur during the same heating state for a given system. In various implementations, the flame rollout switch will be a single-use protection mechanism, and therefore a trip of the flame rollout switch is reported as a fault that will prevent further heating from occurring.

A blower fault is determined based on variation of measured current from a baseline. The measured current may be normalized according to measured voltage, and differential pressure may also be used to identify a blower fault. As the duration and magnitude of deviation between the measured current and the expected current increase, the severity of the fault increases. As the current drawn by the blower goes up, the risk of a circuit breaker or internal protection mechanism tripping increases, which may lead to loss of heating.

A permanent-split capacitor motor is a type of AC induction motor. A fault in this motor may be detected based on variation of power, power factor, and variation from a baseline. A fault in this motor, which may be used as a circulator blower, may be confirmed based on a differential air pressure. As the deviation increases, the severity of the fault increases.

A fault with spark ignition may be detected based on fault of the furnace to progress passed the state at which the spark ignition should ignite the air/fuel mixture. A signature of the spark igniter may be baselined in the frequency domain. Absence of this profile at the expected time may indicate that the spark igniter has failed to operate. Meanwhile, when a profile corresponding to the spark igniter is present but deviates from the baseline, this is an indication that the spark igniter may be failing. As the variation from the baseline increases, the risk of fault increases. In addition to current-based furnace state monitoring, the supply/return temperature split may verify that the heater has failed to commence heating.

A hot surface igniter fault is detected based on analyzing current to determine furnace states. When the current profile indicates that igniter retries have occurred, this may indicate an impending fault of the hot surface igniter. In addition, changes in the igniter profile compared to a baseline may indicate an impending fault. For example, an increase in drive level indicated in either time-domain or frequency-domain current data, an increase in effective resistance, or frequency domain indication of internal arcing may indicate an impending fault of the hot surface igniter.

A fault in the inducer fan or blower is detected based on heater states determined according to current. Faults may be predicted based on frequency domain analysis of inducer fan operation that indicate operational problems, such as fan blades striking the fan housing, water being present in the housing, bearing issues, etc. In various implementations, analysis of the inducer fan may be performed during a time window prior to the circulator blower beginning. The current drawn by the circulator blower may mask any current drawn by the inducer blower.

A fault in the fan pressure switch may be detected when the time-domain current indicates that the furnace restarted but blower fault does not appear to be present and ignition retries were not performed. In other words, the furnace may be operating as expected with the issue that the fan pressure switch does not recognize that the blower motor is not operating correctly. Service may be called to replace the fan pressure switch. In various implementations, the fan pressure switch may fail gradually, and therefore an increase in the number of furnace restarts attributed to the fan pressure switch may indicate an impending fault with the fan pressure switch.

A flame probe fault is detected when a flame has been properly created, but the flame probe does not detect the flame. This is determined when there are ignition retries but frequency-domain data indicates that the igniter appears to be operating properly. Frequency-domain data may also indicate that the gas valve is functioning properly, isolating the fault to the flame probe. A fault in the gas valve may be detected based on the sequence of states in the furnace as indicated by the current. Although the amount of current drawn by the gas valve may be small, a signature corresponding to the gas valve may still be present in the frequency domain. When the signature is not present, and the furnace does not run, the absence of the signature may indicate a fault with the gas valve.

A coil, such as an evaporator coil, may freeze, such as when inadequate airflow fails to deliver enough heat to refrigerant in the coil. Detecting a freezing coil may rely on a combination of inputs, and depends on directional shifts in sensors including temperatures, voltage, time domain current, frequency domain current, power factor, and power measurements. In addition, voltage, current, frequency domain current, and power data may allow other faults to be ruled out.

A dirty filter may be detected in light of changes in power, current, and power factor coupled with a decrease in temperature split and reduced pressure. The power, current, and power factor may be dependent on motor type. When a mass airflow sensor is available, the mass flow sensor may be able to directly indicate a flow restriction in systems using a permanent split capacitor motor.

Faults with compressor capacitors, including run and start capacitors, may be determined based on variations in power factor of the condenser monitor module. A rapid change in power factor may indicate an inoperative capacitor while a gradual change indicates a degrading capacitor. Because capacitance varies with air pressure, outside air temperature may be used to normalize power factor and current data. A fault related to the circulator blower or inducer blower resulting from an imbalanced bearing or a blade striking the respective housing may be determined based on a variation in frequency domain current signature.

A general failure to cool may be assessed after 15 minutes from the call for cool. A difference between a supply air temperature and return air temperature indicates that little or no cooling is taking place on the supply air. A similar failure to cool determination may be made after 30 minutes. If the system is unable to cool by 15 minutes but is able to cool by 30 minutes, this may be an indication that operation of the cooling system is degrading and a fault may occur soon.

Low refrigerant charge may be determined when, after a call for cool, supply and return temperature measurements exhibit lack of cooling and a temperature differential between refrigerant in the suction line and outside temperature varies from a baseline by more than a threshold. In addition, low charge may be indicated by decreasing power consumed by the condenser unit. An overcharge condition of the refrigerant can be determined when, after a call for cool, a difference between liquid line temperature and outside air temperature is smaller than expected. A difference between refrigerant temperature in the liquid line and outside temperature is low compared to a baseline when refrigerant is overcharged.

Low indoor airflow may be assessed when a call for cool and fan is present, and the differential between return and supply air increases above a baseline, suction line decreases below a baseline, pressure increases, and indoor current deviates from a baseline established according to the motor type. Low outdoor airflow through the condenser is determined when a call for cool is present, and a differential between refrigerant temperature in the liquid line and outside ambient temperature increases above a baseline and outdoor current also increases above a baseline.

A possible flow restriction is detected when the return/supply air temperature split and the liquid line temperature is low while a call for cool is present. An outdoor run capacitor fault may be declared when, while a call for cool is present, power factor decreases rapidly. A general increase in power fault may be declared when a call for cool is present and power increases above a baseline. The baseline may be normalized according to outside air temperature and may be established during initial runs of the system, and/or may be specified by a manufacturer. A general fault corresponding to a decrease in capacity may be declared when a call for cool is present and the return/supply air temperature split, air pressure, and indoor current indicate a decrease in capacity.

In a heat pump system, a general failure to heat fault may be declared after 15 minutes from when a call for heat occurred and the supply/return air temperature split is below a threshold. Similarly, a more severe fault is declared if the supply/return air temperature split is below the same or different threshold after 30 minutes. A low charge condition of the heat pump may be determined when a call for heat is present and a supply/return air temperature split indicates a lack of heating, a difference between supply air and liquid line temperatures is less than a baseline, and a difference between return air temperature and liquid line temperature is less than a baseline. A high charge condition of the heat pump may be determined when a call for heat is present, a difference between supply air temperature and liquid line temperature is high, a difference between a liquid line temperature and return air temperature is low, and outdoor power increases.

Low indoor airflow in a heat pump system, while a call for heat and fan are present, is detected when the supply/return air temperature split is high, pressure increases, and indoor current deviates from a baseline, where the baseline is based on motor type. Low outdoor airflow on a heat pump is detected when a call for heat is present, the supply/return air temperature split indicates a lack of heating as a function of outside air temperature, and outdoor power increases.

A flow restriction in a heat pump system is determined when a call for heat is present, supply/return air temperature split does not indicate heating is occurring, runtime is increasing, and a difference between supply air and liquid line temperature increases. A general increase in power consumption fault for heat pump system may indicate a loss of efficiency, and is detected when a call for heat is present and power increases above a baseline as a function of outside air temperature.

A capacity decrease in a heat pump system may be determined when a call for heat is present, a supply/return air temperature split indicates a lack of heating, and pressure split in indoor current indicate a decreased capacity. Outside air temperature affects capacity, and therefore the threshold to declare a low capacity fault is adjusted in response to outside air temperature.

A reversing valve fault is determined when a call for heat is present but supply/return air temperature split indicates that cooling is occurring. Similarly, a reversing valve fault is determined when a call for cool is present but supply/return air temperature split indicates that heating is occurring.

A defrost fault may be declared in response to outdoor current, voltage, power, and power factor data, and supply/return air temperature split, refrigerant supply line temperature, suction line temperature, and outside air temperature indicating that frost is occurring on the outdoor coil, and defrost has failed to activate. When a fault due to the reversing valve is ruled out, a general defrost fault may be declared.

Excessive compressor tripping in a heat pump system may be determined when a call for cool or heating is present, supply/return air temperature split lacks indication of the requested cooling or heating, and outdoor fan motor current rapidly decreases. A fault for compressor short cycling due to pressure limits being exceeded may be detected when a call for cool is present, supply/return air temperature split does not indicate cooling, and there is a rapid decrease in outdoor current and a short runtime. A compressor bearing fault may be declared when an FFT of outdoor current indicates changes in motor loading, support for this fault is provided by power factor measurement. A locked rotor of the compressor motor may be determined when excessive current is present at a time when the compressor is slow to start. A locked rotor is confirmed with power and power factor measurements.

Thermostat short cycling is identified when a call for cool is removed prior to a full cooling sequence being completed. For example, this may occur when a supply register is too close to the thermostat, and leads to the thermostat prematurely believing the house has reached a desired temperature.

When a call for heat and a call for cool are present at the same time, a fault with the thermostat or with the control signal wiring is present. When independent communication between a monitor module and a thermostat is possible, such as when a thermostat is Internet-enabled, thermostat commands can be compared to actual signals on control lines and discrepancies indicate faults in control signal wiring.

Returning back to FIG. 2A, in order for the monitoring system to determine which mode the HVAC system is operating in, each control signal between the thermostat 208 and the control module 112 may be monitored. Because the monitoring system of the present disclosure can be used in a retrofit environment, this may require connecting leads to each of the control lines. Making individual connections requires additional installation time and therefore expense. As the number of connections increase, the number of opportunities for a loose connection, and therefore erroneous readings, increase.

Further, because connecting leads may require removing and reattaching control lines from the control module, the loose connection may even affect normal operation of the HVAC system, such as the ability of the thermostat 208 to control certain aspects of the control module 112. Further, a location at which the control lines are accessible may be difficult for an installer to reach without removing other components of the HVAC system, which increases installation time and also increases the risk of introducing problems.

With multiple connections, even when the control lines are successfully connected, there is a risk that the connections will be misidentified—e.g., leading the monitoring system to believe that a call for cool has been made by the thermostat 208 when, in fact, a call for heat was instead made. Some HVAC systems may use those control lines in a non-standard way. Again, this may lead to misinterpretation of the control signals by the monitoring system. A further complication is introduced by "communicating systems," which do not rely on standard HVAC control lines and instead multiplex multiple signals onto one or more control lines. For example only, in a communicating system the thermostat 208 and the control module 112 may perform bidirectional digital communication using two or more lines. As a result, individual control lines corresponding to each mode of operation of the HVAC system may not be present.

The present disclosure presents an alternative to individually sensing the control lines and this alternative may eliminate or mitigate some or all of the issues identified above. When the thermostat 208 makes a call for heat, one or more components of the HVAC system will draw a current to service the call for heat. For example, a relay (not shown) may be energized to open the gas valve 128. Meanwhile, when a call for cool is made by the thermostat 208, other components may draw a current—for example, a relay may control the control module 156.

The current consumed by these various devices may be different. For example, the current required to close a switch of the control module 156 may be greater than the current required to open the gas valve 128. An aggregate control line current may therefore uniquely indicate various modes of operation. In FIG. 2A, a current sensor 400 is shown associated with the control signals exchanged between the thermostat 208 and the control module 112. The current is received by the air handler monitor module 200.

In some HVAC systems, the difference in current between two different modes may not be distinguishable with sufficient accuracy. For these situations, additional sensing may be required. For example, a sensor may be connected to a specific control line to provide additional information so that the mode of operation can be disambiguated.

In FIG. 4, example aggregate control line currents are shown for five different operational modes of a particular HVAC system. In an idle mode, none of the control lines are activated and an aggregate current is 40 mA. In heating mode, a "W" control line, which indicates a call for heat, results in an aggregate current level of 60 mA. In a fan-only mode (for many thermostats, this is when the fan setting is changed from auto to on) a "G" control line is activated, resulting in an aggregate control line current of 110 mA.

When a call for heating is combined with a call for fan, both control lines, "W" and "G" are activated, resulting in an aggregate line current of 150 mA. When a call for cool is made, control lines "Y" and "G" are activated with a resulting control line current of 600 mA.

Note that for the heating mode, the "W" control line can be activated by itself (without requiring activation of the "G" line). This is because in some HVAC systems, such as used for FIG. 4, a call for heat using the "W" control line automatically results in the fan being activated. Meanwhile, in some HVAC systems, including the example used for FIG. 4, the thermostat explicitly enables the fan (using the "G" line) when making a call for cool.

Note that the control line currents for activation of the "W" and "G" control lines independently do not add up to equal the control line current when the "W" and "G" lines are activated together. The inability to calculate the aggregate control line current by linear superposition may be a common feature in HVAC systems. For example, various components activated by the "W" control line and the "G" control line may be common so that when both the "W" and "G" control lines are activated, those common components only contribute once to the aggregate control line current.

Figure 5A:
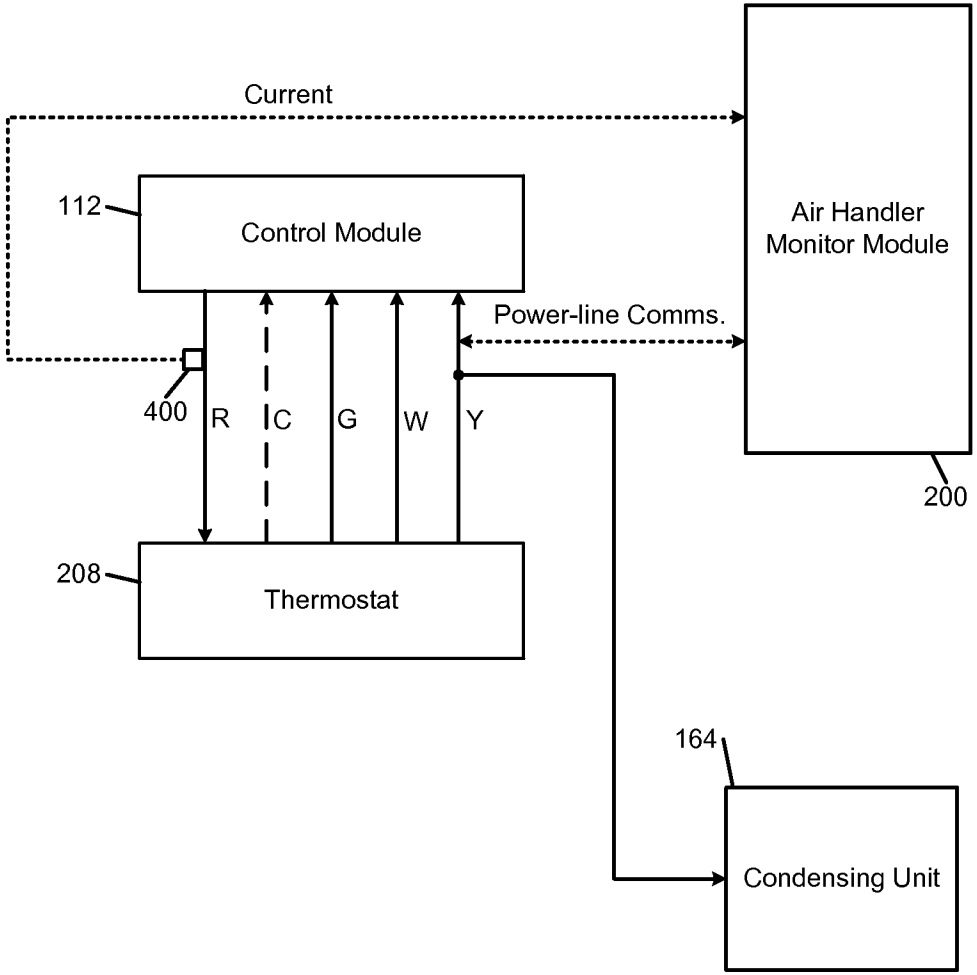
FIGS. 5A-5B are functional block diagrams showing additional detail of example control lines between a thermostat and a control module.

In FIG. 5A, a more detailed view of the control signals for an example HVAC system is shown. The thermostat 208 received power over an "R" control line. In some implementations, a "C" control line provides a current return path. The "C" control line is omitted in various HVAC systems. A "G" line indicates a call for the circulator blower, or fan. A "W" line indicates a call for heating. A "Y" line indicates a call for cooling. The air handler monitor module 200 monitors a current sensed by the current sensor 400. The current sensor 400 may measure the "R" line (as show in FIG. 5A) or, in systems with a "C" line, may measure the "C" line (not shown). The air handler monitor module 200 performs power-line communications with the condensing unit 164 over a shared line, such as over the "Y" line.

In systems without cooling, the "Y" line may be omitted and, in systems without heating, the "W" line may be omitted. Further, the "G" line may be omitted in systems where the fan is always actuated automatically. Additional control lines that may be present include a "Y2" line that indicates a second stage call for cool. For example, the "Y2" line may indicate that the cooling should be greater or lesser than for the "Y" line. An adjustment in the amount of cooling may be accomplished by adjusting how many compressors are used to provide cooling and/or by adjusting a capacity of a compressor, such as with an unloader valve, a variable speed drive, etc.

A "W2" line may provide for second stage heating, which in a heat pump may include an electric secondary heating element. An "O/B" line may be used to control a mode of the heat pump. The heat pump systems may include additional control lines such as an EMR (Energy Management Recovery) line or an auxiliary heat line. Additional and alternative control lines may be present in various other HVAC systems for which the monitoring system is used.

While the letter of each control line may indicate a commonly-used color for the shielding of the wire, the actual colors and labels of the control lines may differ in real world systems. For this reason, the aggregate current may be a more reliable indicator of mode than the state of individual, unspecified control lines.

Figure 5B:
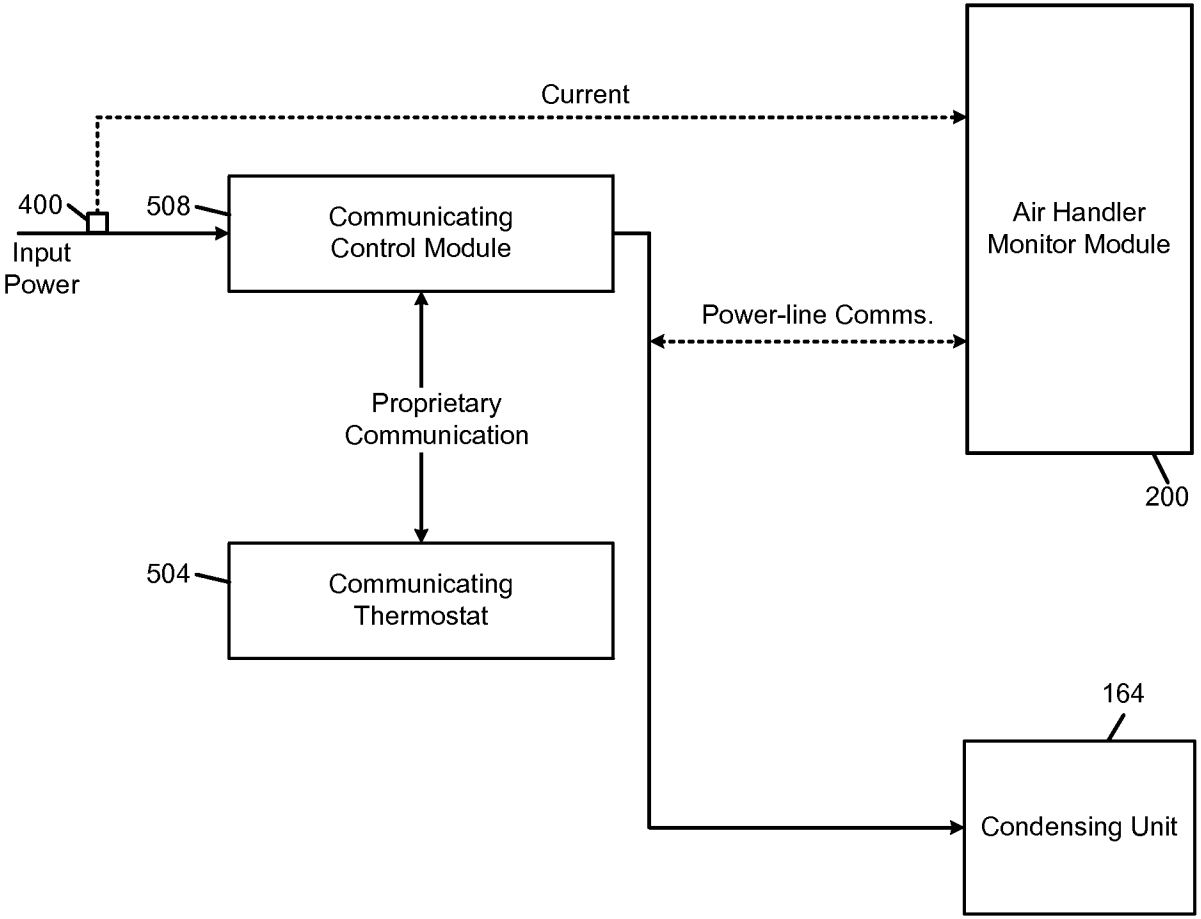

In FIG. 5B, a communicating thermostat 504 communicates with a communicating control module 508 using some form of proprietary communication such as a bidirectional digital interface. The current sensor 400 may therefore measure input power to the communicating control module 508. The measured current is received by the air handler monitor module 200. The condensing unit 164 may receive a single control signal from the communicating control module 508. The air handler monitor module 200 may therefore use that control line for power-line communications with the condensing monitor module 204.

Figure 6:
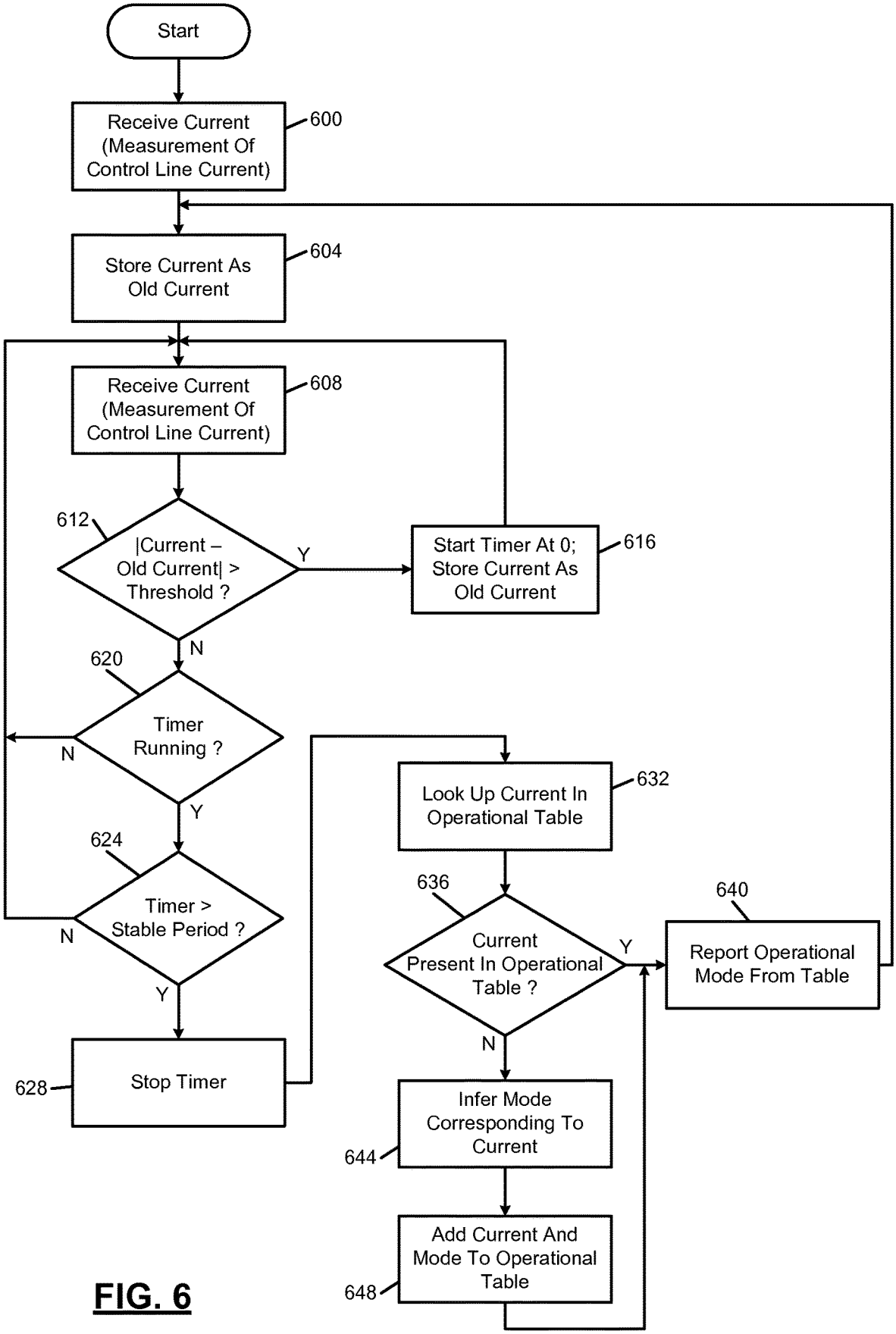
FIG. 6 is a flowchart of example operation of a monitoring system that determines operating mode of an HVAC system based on control line current.

In FIG. 6, a flowchart shows example operation of a monitoring system that determines HVAC operation mode based on aggregate control line current. Control begins at 600, where a current measurement is received corresponding to an aggregate measure of control line currents. Control continues at 604 where the received current is stored as an old current to which future currents will be compared.

Control continues at 608 where a new current measurement is received. Control continues at 612 where, if an absolute value of the difference between the present current and the stored old current is greater than a threshold, control transfers to 616; otherwise, control transfers to 620. At 616, a timer is started at a value of zero and the present current is stored as the old current. Control then returns to 608.

The timer may be implemented to force a wait interval for the aggregate current value to stabilize at a steady state value. When the mode of the HVAC system changes, the value of the current may initially take a period of time to stabilize. At 620, if the timer is running, indicating that a large change in current had occurred, implying a potential change in mode, control transfers to 624; otherwise, control returns to 608.

At 624, the timer was started and, therefore, the present value of the timer is compared to a predetermined stable period of time. If the timer exceeds that predetermined stable period, control transfers to 628; otherwise, control returns to 608. At 628, the timer is stopped and at 632 the current, which is the most recent value of the current and represents a steady state current, is looked up in an operational table.

For example only, the operational table may be similar in concept to that shown in FIG. 4. While FIG. 4 shows an individual current value for each mode of operation, a range may be defined around each current value in the table. This may take the form of a percentage of the current value, or upper and lower limits may be explicitly defined. For example only, each current level in the table may be associated with an uncertainty of plus or minus ten percent. Therefore, if the present value of the current is within plus or minus ten percent of the value in the table, that table entry may be assumed to be the correct table entry. Control continues at 636, where if the value of the current corresponds to a row in the operational table, control transfers to 640; otherwise, control transfers to 644.

In various implementations, the operational table may be predefined based on the identity of the HVAC system. The current levels may be empirically determined and/or specified by the manufacturer for a specific model and configuration of HVAC system. This table may be stored in the monitoring system and accessed based on an identifier associated with the installed HVAC system. In other implementations, the operational table may be generated as part of a calibration routine, which may be performed by an installer of the monitoring system and/or a customer.

In various implementations, the thermostat may have a predetermined calibration routine to allow this table to be generated by cycling through each of the modes in a predetermined order. In implementations where the operational table is predefined, a determination that the current is not present in the operational table signals an error. This may be reported to the customer and/or an HVAC contractor as either the table needs to be updated or a fault is causing the current to deviate from what is predefined in the table.

In the example shown in FIG. 6, the table is not predefined, and is instead constructed by the monitoring system. Therefore, at 644, control infers the mode corresponding to the current, which has been determined to not be present in the operational table. For example, this mode may be inferred based on temperature measurements. If an outside ambient air temperature is above a certain threshold, it is likely that a cooling mode has been initiated. If the outside ambient temperature is below a certain threshold, it is likely that a heating mode has been enabled.

Further, the supply air temperature may indicate whether heating or cooling is being performed. And specifically, a difference between the supply air temperature and the return air temperature indicates whether heat is being added or removed to circulating air. In situations where the supply air and return air temperatures differ by only a small amount, an air flow sensor may be able to determine whether the fan-only mode is engaged. Meanwhile, when the supply air and return air temperatures differ by only a small amount and there is an indication that minimal air flow is occurring (such as from an airflow sensor), the system is likely in an idle state.

Various other heuristics may be used, such as an inference that a control line current that is more than ten times a lowest measured current corresponds to a cooling mode. This is because the contactor for an air conditioning compressor may draw significantly more current than the components active in an idle system. The time of year and geographical location of the HVAC system may inform the mode inference. For example, a current level that is first seen in October, in a colder climate, is likely to be related to a call for heating.

In addition, system current data (i.e., the measured currents from current sensors 216 and 264) can be used to infer the operating mode of the HVAC system. Air conditioning, gas furnace, electric heater, and fan-only modes may exhibit distinct system current patterns. For example, air conditioning and fan-only modes may have the same indoor current pattern (including just the blower motor). However, the air conditioning mode will exhibit a significant outdoor system current draw.

A gas furnace has a distinctive system current profile that starts with inducer fan operation, followed by ignition, then a purging (or waiting) period to allow the heat exchanger to heat up, then blower operation. Meanwhile, an electric heater generally draws significantly greater indoor system current than does a gas-powered furnace and also does not have the initial steps (inducer fan, ignition, etc.) associated with a gas furnace.

After the mode is inferred, control continues at 648, where the current level and mode are added to the operational table. Control then continues at 640. At 640, control reports the operational mode that is determined from the table. The reported operational mode may be reflected on the contractor portal 328 or the customer portal 332 of the remote monitoring system 304.

In addition, the table may be updated with information regarding how the present current differs from the stored current level. For example, if, over time, all of the current levels associated with the heating mode are five percent higher than the nominal current level stored in the operational table, the operational table may be adjusted so that the measured current falls in the middle of the range of the stored current level. This may allow for small drifts in current as the HVAC system ages.

At 652, control determines a system condition of the HVAC system. The system condition may include detections of various faults, including those described above. The system condition may include predictions of various faults, as described above. The system condition may also include a reduction in performance or efficiency—while such a condition may also be characterized as a fault, it may be treated separately from a fault when there is no corresponding system component that has actually failed. Control then returns to 604.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules.

The term memory is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium include nonvolatile memory (such as flash memory), volatile memory (such as static random access memory and dynamic random access memory), magnetic storage (such as magnetic tape or hard disk drive), and optical storage.

The apparatuses and methods described in this application may be partially or fully implemented by one or more computer programs executed by one or more processors. The computer programs include processor-executable instructions that are stored on at least one non-transitory, tangible computer-readable medium. The computer programs may also include and/or rely on stored data.

What is claimed is:

1. A monitoring system for monitoring a heating, ventilation, and air conditioning (HVAC) system of a building, the monitoring system comprising:

a monitoring device installed at the building, wherein:

a thermostat activates a first operating mode of the HVAC system via a first line of a plurality of control lines, the thermostat activates a second operating mode of the HVAC system via a second line of the plurality of control lines, the monitoring device is configured to measure an electrical parameter related to the plurality of control lines, the monitoring device is configured to determine an aggregate control line current value based on the electrical parameter, the aggregate control line current value represents a total current flowing through the plurality of control lines, and the monitoring device is configured to transmit the aggregate control line current value; and a monitoring server configured to:

receive the aggregate control line current value from the monitoring device;

determine a commanded operating mode of the HVAC system based on the aggregate control line current value; and analyze a system condition of the HVAC system based on the determined commanded operating mode.

2. The monitoring system of claim 1 wherein the system condition includes at least one of a detected fault of the HVAC system and a predicted fault of the HVAC system.

3. The monitoring system of claim 2 wherein the monitoring server is configured to generate an alert for at least one of a customer and a contractor in response to determining presence of at least one of the detected fault and the predicted fault.

4. The monitoring system of claim 1 wherein the monitoring server is located remotely from the building.

5. The monitoring system of claim 1 wherein:

the monitoring device includes a current sensor configured to measure a first current flowing through a conductor supplying power to the thermostat, and the monitoring device is configured to determine the aggregate control line current value based on the first current.

6. The monitoring system of claim 1 wherein:

the monitoring device includes a voltage sensor configured to measure a voltage on an output side of a transformer associated with the plurality of control lines, the monitoring device is configured to determine the aggregate control line current value based on an apparent transformer ratio, and the apparent transformer ratio is based on the measured voltage of the output side of the transformer and a voltage on an input side of the transformer.

7. The monitoring system of claim 1 wherein:

the monitoring device includes a voltage sensor configured to measure a voltage associated with the plurality of control lines, and the monitoring device is configured to determine the aggregate control line current value based on the measured voltage.

8. The monitoring system of claim 1 further comprising a second monitoring device, wherein:

the second monitoring device includes a current sensor configured to measure an aggregate control line current consumed by an outdoor unit of the HVAC system; and the monitoring server is configured to infer, in response to the commanded operating mode of the HVAC system being unknown, the commanded operating mode using the aggregate control line current consumed by the outdoor unit.

9. The monitoring system of claim 1 wherein operating modes of the HVAC system include a plurality of operating modes including at least two of the following: a fan only mode, a heating mode, a second stage heating mode, a cooling mode, a second stage cooling mode, an auxiliary heating mode, and an emergency mode.

10. The monitoring system of claim 1 wherein the monitoring server is configured to:

store a table of aggregate control line current values with respect to operating modes of the HVAC system; and determine the commanded operating mode of the HVAC system based on the table.

11. The monitoring system of claim 10 wherein the table includes an aggregate control line current value corresponding to each of the operating modes of the HVAC system.

12. The monitoring system of claim 11 wherein:

the table includes a first upper limit and a first lower limit that correspond to the first operating mode; and the monitoring server is configured to determine that the commanded operating mode of the HVAC system is the first operating mode in response to the received aggregate control line current value being greater than or equal to the first lower limit and less than or equal to the first upper limit.

13. The monitoring system of claim 10 wherein the table is predefined upon commissioning of the HVAC system.

14. The monitoring system of claim 10 wherein the table is predefined based on a model number of the HVAC system.

15. The monitoring system of claim 10 wherein the monitoring server is configured to populate the table.

16. The monitoring system of claim 1 wherein the monitoring server is configured to, in response to the commanded operating mode of the HVAC system being unknown, infer the commanded operating mode based on additional data.

17. The monitoring system of claim 16 wherein the monitoring server is configured to store the inference along with the received aggregate control line current value for future use.

18. The monitoring system of claim 16 wherein the additional data includes outside ambient temperature in a geographical region of the HVAC system.

19. The monitoring system of claim 16 wherein the additional data includes supply air temperature of the HVAC system.

20. The monitoring system of claim 16 wherein the additional data includes a refrigerant line temperature of the HVAC system.

21. The monitoring system of claim 16 wherein the additional data includes a time of year.

22. The monitoring system of claim 16 wherein the additional data includes an aggregate current consumption of the HVAC system.

23. The monitoring system of claim 22 wherein the aggregate current consumption of the HVAC system includes all current drawn by components of at least one of (i) an indoor enclosure of the HVAC system and (ii) an outdoor enclosure of the HVAC system.

24. The monitoring system of claim 23 wherein the additional data includes at least one of:

a steady-state value of the aggregate current consumed by the indoor enclosure; and a time-domain or frequency-domain signature of the aggregate current consumed by the indoor enclosure.

* * * * *